United States Patent [19]

Milligan et al.

[11] Patent Number: 4,598,526

[45] Date of Patent: Jul. 8, 1986

[54] SYSTEM FOR BOXING FORMS

[75] Inventors: Timothy H. Milligan, Beaverton, Oreg.; Robert B. Johnson, Santa Clara, Calif.

[73] Assignee: Willamette Industries, Inc., Beaverton, Oreg.

[21] Appl. No.: 609,451

[22] Filed: May 11, 1984

[51] Int. Cl.[4] ..... B65B 5/04

[52] U.S. Cl. ..... 53/251; 198/782

[58] Field of Search ..... 53/55, 531, 539, 544, 53/564, 247, 249, 251, 252, 260, 281, 436, 467, 473; 198/424, 782; 414/80, 82

[56] References Cited

U.S. PATENT DOCUMENTS

| | | | |
|---|---|---|---|
| 4,067,172 | 1/1978 | Paules | 53/55 X |
| 4,124,967 | 11/1978 | Beer et al. | 53/544 X |
| 4,479,345 | 10/1984 | Nord | 53/564 |
| 4,506,493 | 3/1985 | Horton | 53/247 X |
| 4,520,614 | 6/1985 | Aykut | 53/247 X |

FOREIGN PATENT DOCUMENTS

| | | | |
|---|---|---|---|
| 2460850 | 7/1975 | Fed. Rep. of Germany | 53/485 |

*Primary Examiner*—John Sipos
*Assistant Examiner*—Steven P. Weihrouch
*Attorney, Agent, or Firm*—Klarquist, Sparkman, Campbell, Leigh & Whinston

[57] ABSTRACT

A system for boxing printed forms uses half-slotted (hsc) containers and apparatus for assembling the containers, filling them with forms, compressing the forms, applying a lid, and strapping the lid on the container. Two parallel conveyor systems are used in the apparatus. A forms infeed accumulator conveyor infeeds stacks of forms to a form-dropping mechanism aligned above a parallel box-receiving conveyor. A folded box infeed tray, a box opening mechanism, and bottom flap folding members assemble boxes one at a time. A box pusher transfers the formed box onto the receiving conveyor and lateral guides and sensor controls precisely position the box beneath the form-dropping mechanism. The dropping mechanism has two rows of live roller-fingers abutting end to end and are movable laterally apart to drop the forms into a box below. The roller fingers are driven faster than the accumulator conveyor and cooperate with a gate to the dropping mechanism to separate and detain successive stacks while each stack is being dropped. A container and forms guide arrangement is suspended from the infeed conveyor and vertically adjustable as a unit for different height boxes. The box-receiving conveyor is lowered upon discharge to allow the boxed forms to pass beneath the interfacing guide frame. Automatic sensor and actuator controls orchestrate box erection and infeed, forms infeed and dropping, raising and lowering the receiving and discharge conveyor, and interlock operation of the various mechanisms so that forms are only dropped into an empty box. The boxes are sized to close tolerances about the forms to air-cushion the dropping stack.

21 Claims, 21 Drawing Figures

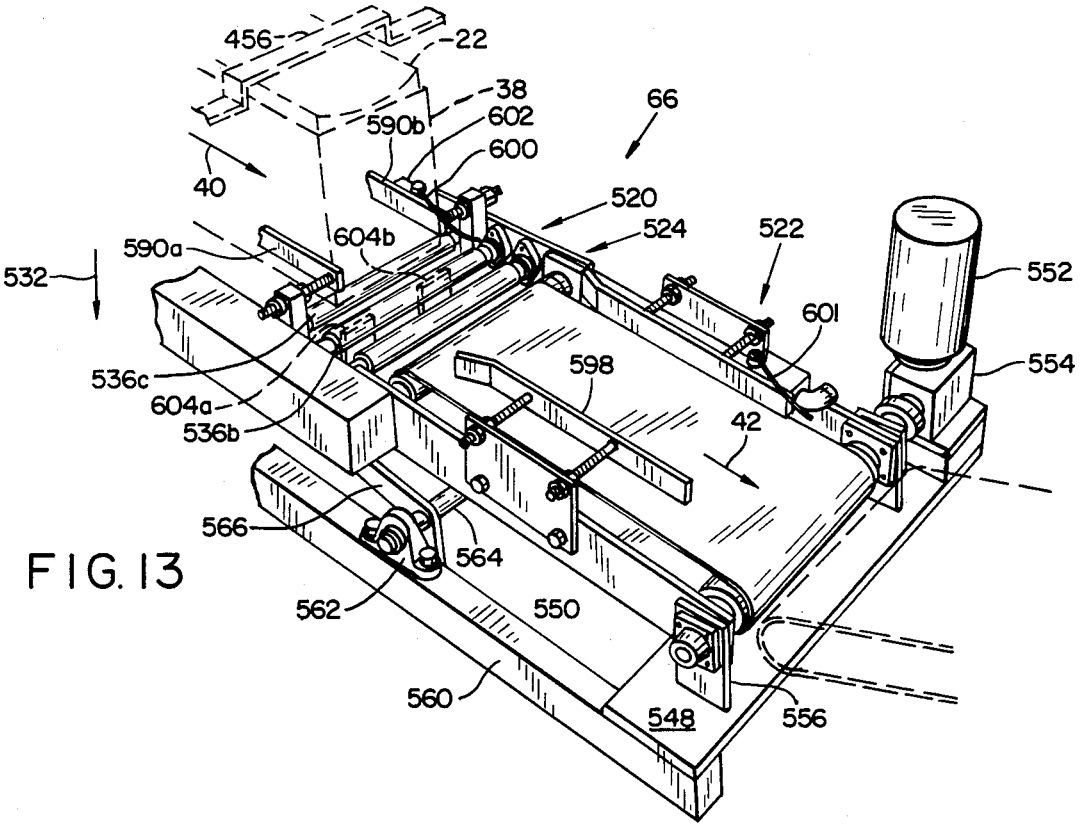
FIG. 13
FIG. 14
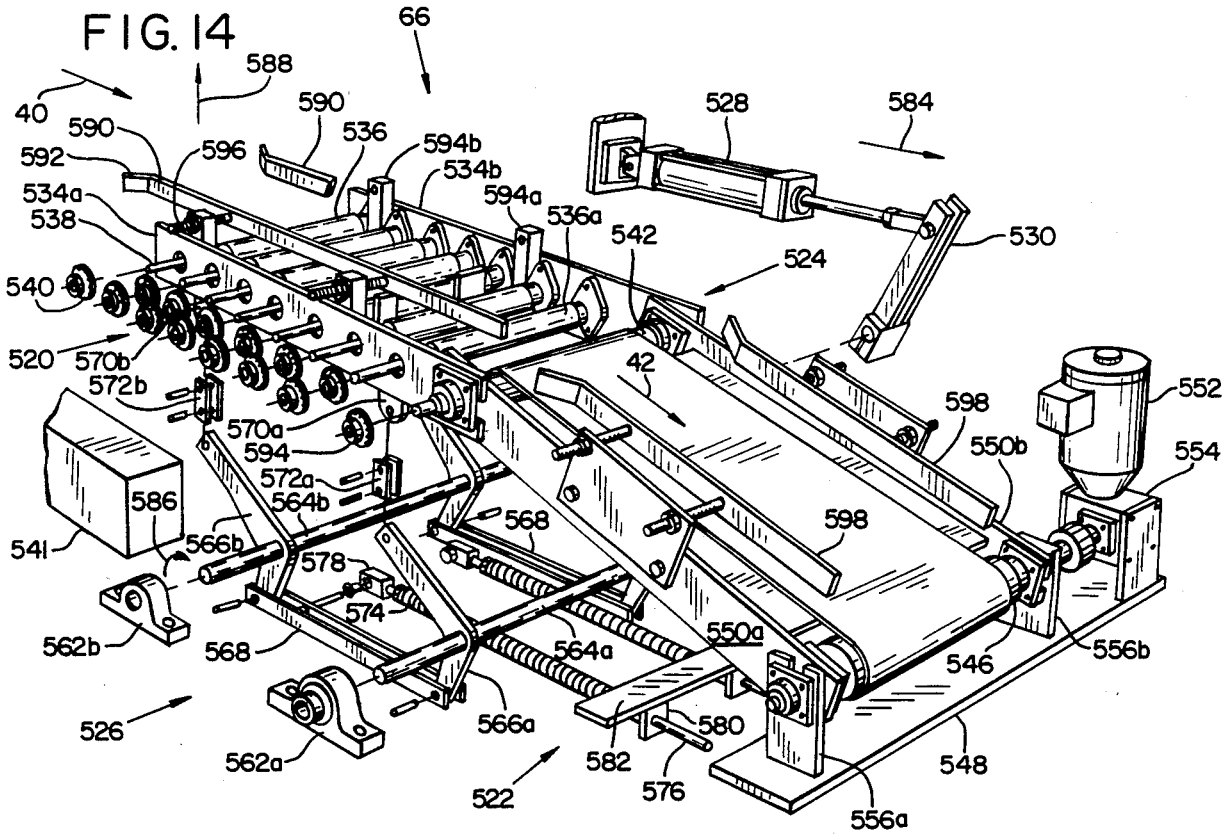

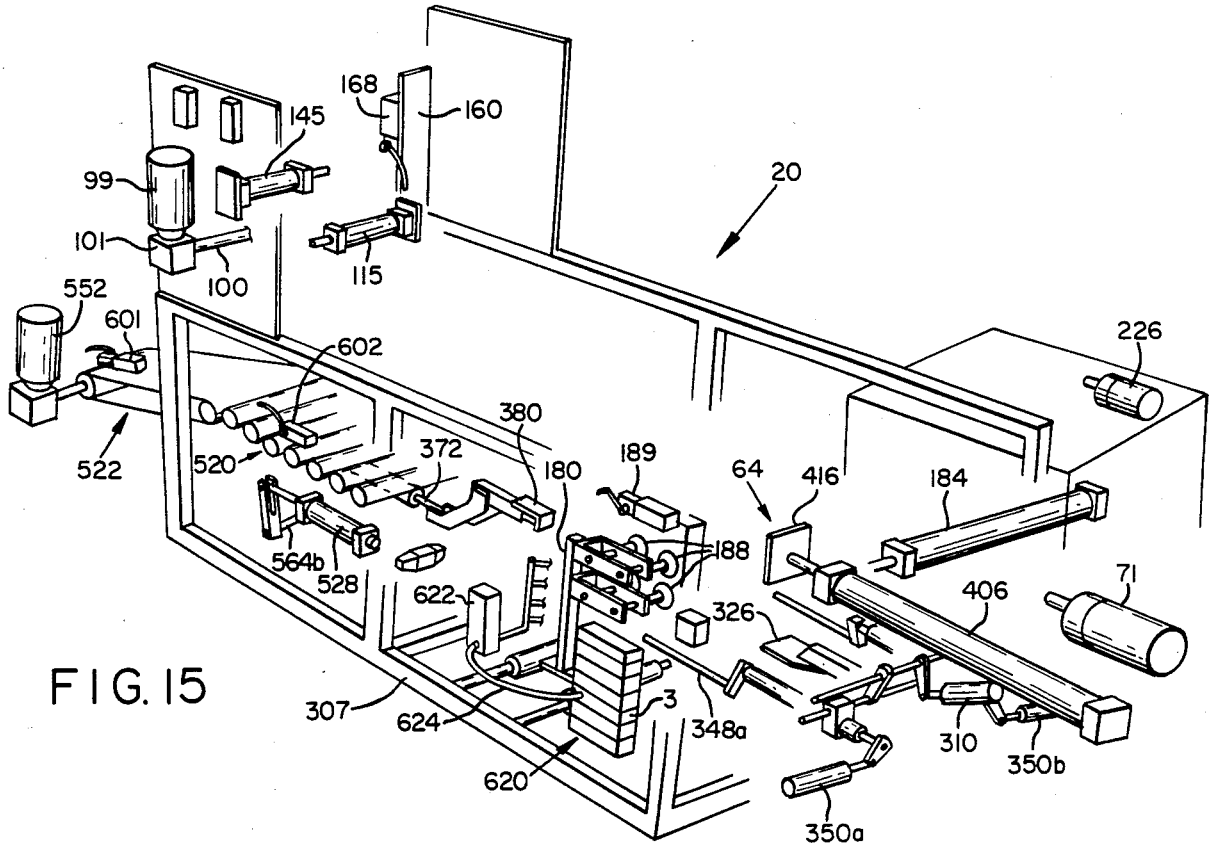
FIG. 15
FIG. 16a
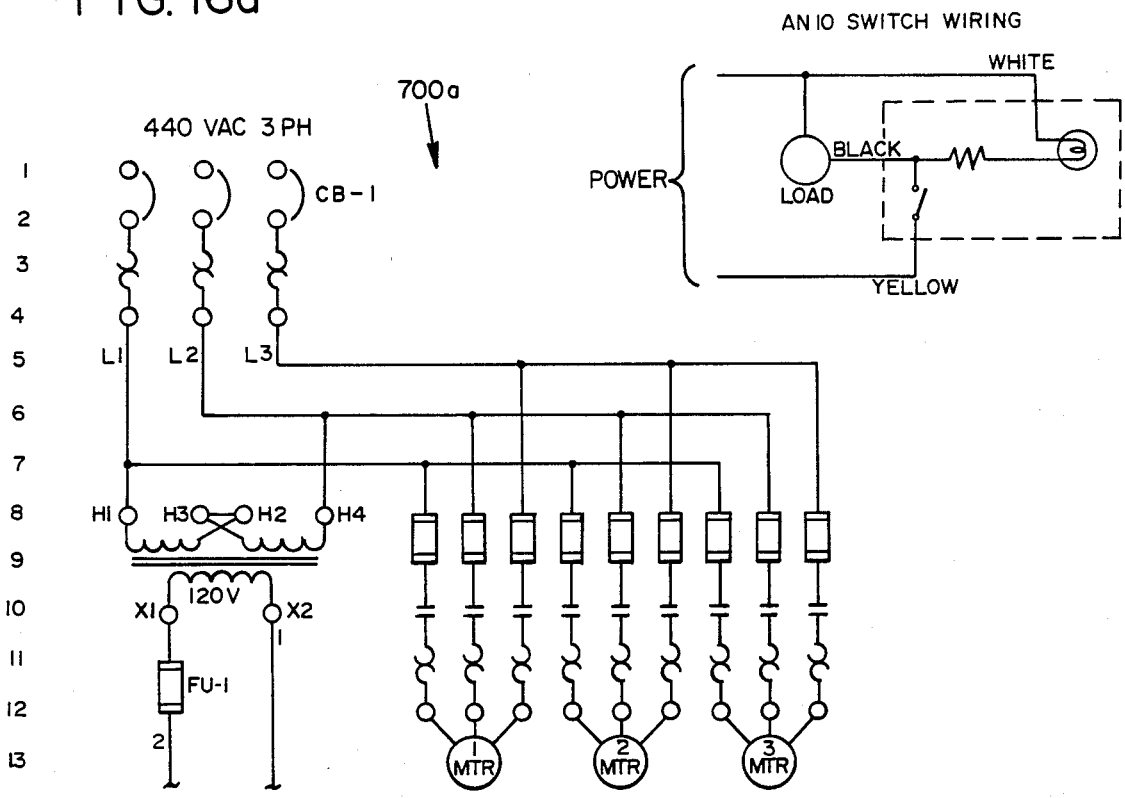

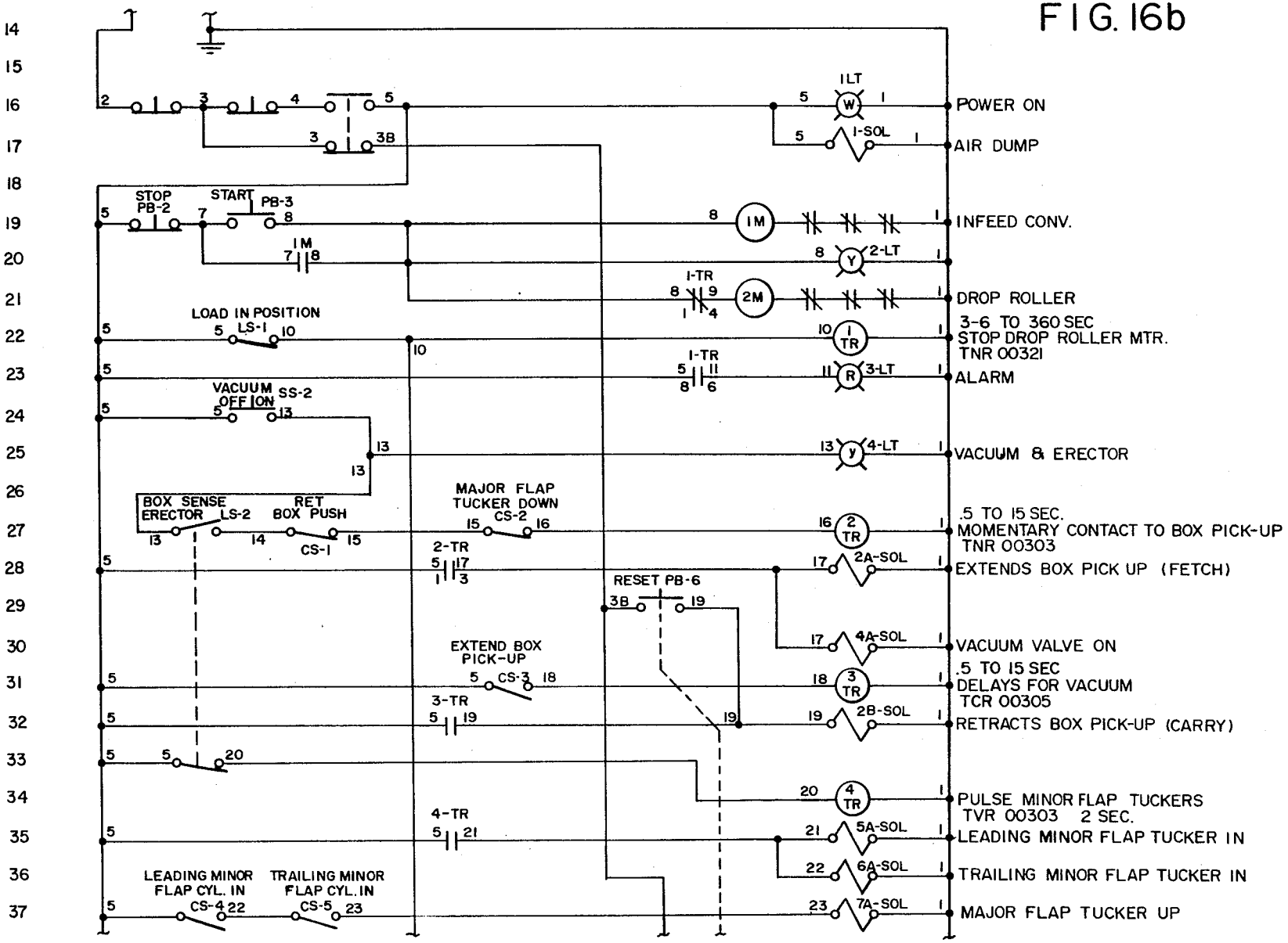
FIG. 16b
POWER ON
AIR DUMP
INFEED CONV.
DROP ROLLER
3-6 TO 360 SEC STOP DROP ROLLER MTR. TNR 00321
ALARM
VACUUM & ERECTOR
.5 TO 15 SEC. MOMENTARY CONTACT TO BOX PICK-UP TNR 00303
EXTENDS BOX PICK UP (FETCH)
VACUUM VALVE ON
.5 TO 15 SEC DELAYS FOR VACUUM TCR 00305
RETRACTS BOX PICK-UP (CARRY)
PULSE MINOR FLAP TUCKERS TVR 00303 2 SEC.
LEADING MINOR FLAP TUCKER IN
TRAILING MINOR FLAP TUCKER IN
MAJOR FLAP TUCKER UP
1LT
1-SOL
1M
2-LT
2M
1-TR
3-LT
4-LT
2 TR
2A-SOL
4A-SOL
3 TR
2B-SOL
4 TR
5A-SOL
6A-SOL
7A-SOL
RESET PB-6
MAJOR FLAP TUCKER DOWN CS-2
2-TR
EXTEND BOX PICK-UP CS-3
3-TR
4-TR
START PB-3
STOP PB-2
LOAD IN POSITION LS-1
VACUUM SS-2 OFF ON
BOX SENSE ERECTOR LS-2
RET BOX PUSH CS-1
TRAILING MINOR FLAP CYL. IN CS-5
LEADING MINOR FLAP CYL. IN CS-4

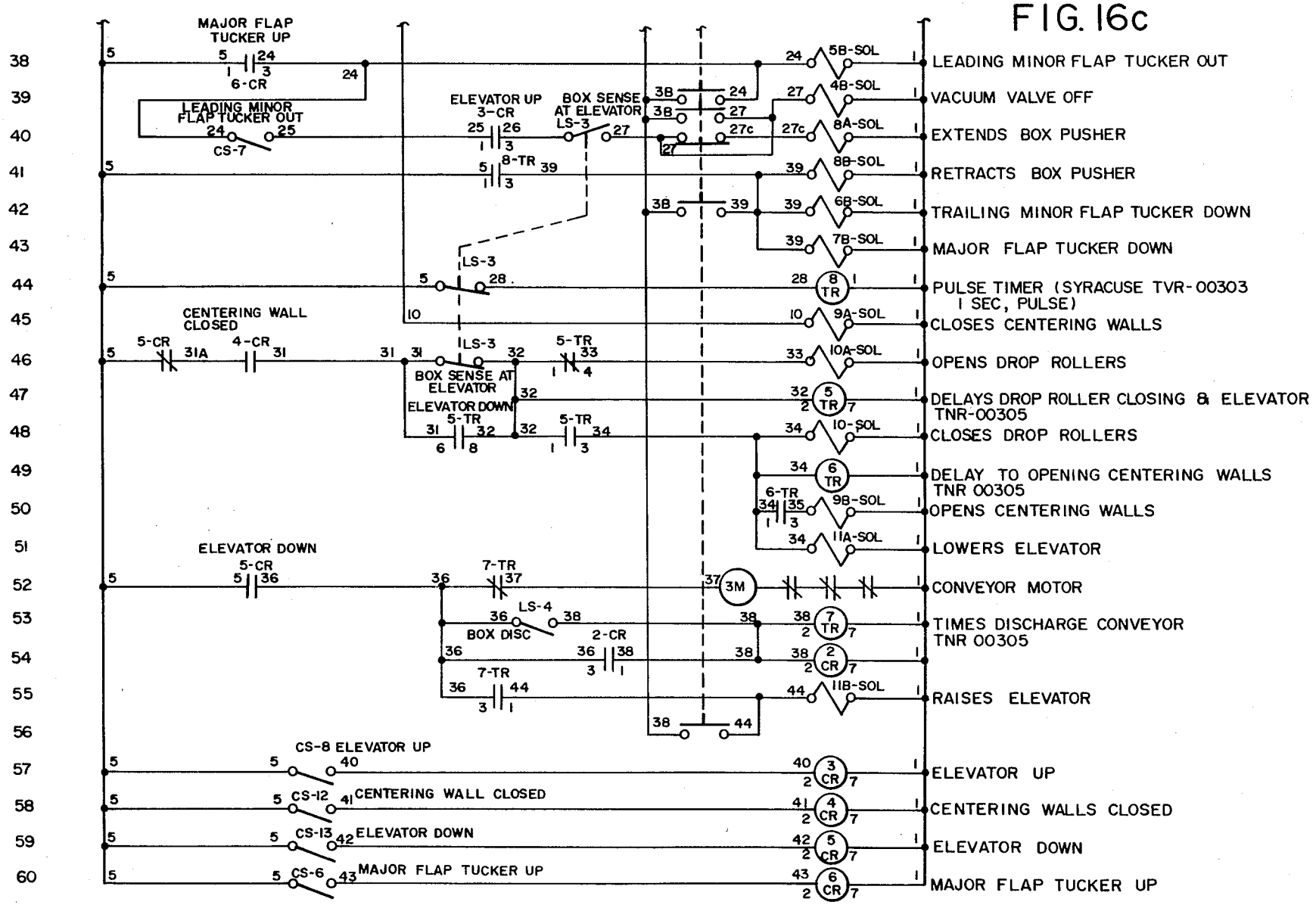
FIG. 16c
LEADING MINOR FLAP TUCKER OUT
VACUUM VALVE OFF
EXTENDS BOX PUSHER
RETRACTS BOX PUSHER
TRAILING MINOR FLAP TUCKER DOWN
MAJOR FLAP TUCKER DOWN
PULSE TIMER (SYRACUSE TVR-00303 1 SEC, PULSE)
CLOSES CENTERING WALLS
OPENS DROP ROLLERS
DELAYS DROP ROLLER CLOSING & ELEVATOR TNR-00305
CLOSES DROP ROLLERS
DELAY TO OPENING CENTERING WALLS TNR 00305
OPENS CENTERING WALLS
LOWERS ELEVATOR
CONVEYOR MOTOR
TIMES DISCHARGE CONVEYOR TNR 00305
RAISES ELEVATOR
ELEVATOR UP
CENTERING WALLS CLOSED
ELEVATOR DOWN
MAJOR FLAP TUCKER UP
5B-SOL
4B-SOL
8A-SOL
8B-SOL
6B-SOL
7B-SOL
8 TR
9A-SOL
10A-SOL
5 TR
10-SOL
6 TR
9B-SOL
11A-SOL
7 TR
2 CR
11B-SOL
3 CR
4 CR
5 CR
6 CR
3M
BOX SENSE AT ELEVATOR LS-3
ELEVATOR UP 3-CR
8-TR
LS-3
5-TR
BOX SENSE AT ELEVATOR
ELEVATOR DOWN 5-TR
7-TR
LS-4
BOX DISC
2-CR
CS-8 ELEVATOR UP
CENTERING WALL CLOSED
CS-12
CS-13
ELEVATOR DOWN
CS-6
MAJOR FLAP TUCKER UP
MAJOR FLAP TUCKER UP 6-CR
LEADING MINOR FLAP TUCKER OUT
CS-7
CENTERING WALL CLOSED 4-CR
5-CR
ELEVATOR DOWN 5-CR

SYSTEM FOR BOXING FORMS

BACKGROUND OF THE INVENTION

This invention relates generally to the packaging of forms, and more particularly to the boxing of stacked forms, such as continuous form paper of the type used by computer printers.

Computer printout paper is conventionally printed from large rolls, divided lengthwise into a desired width, and perforated and accordion-folded at page intervals to form a stack of continuous forms. The following description proceeds with reference to forms of this type, but the invention is also applicable to packaging of other kinds of forms.

For ease of shipment and handling, it is desirable to package the forms in boxes. Conventionally, this task is performed manually, using a regular slotted container (RSC), which is a commonly available type of corrugated cardboard box having flaps on both top and bottom. This procedure typically requires at least two workmen for each form manufacturing and packaging line. Conventional form printing and cutting machinery outfeeds the form paper in several parallel continuous stacks onto a tray. There, one workman separates from each continuous stack discrete stacks of equal numbers of sheets, for example, 4,000 sheets per stack. The containers are conventionally provided in folded form, known as "knockdown" containers, which the second workman erects by manually opening them one at a time, upside down and folding and taping the bottom flaps thereof. Then, with the container still turned upside-down, it is fitted downwardly over a discrete stack of forms. The top flaps of the container assist in guiding the sides of the box downward along the edges of the stacked forms. Once filled, each container is turned over and closed by the workmen manually pressing down the stack of forms and folding and taping the top flaps down atop the forms.

Ideally, the containers are sized in their vertical dimension between the top and bottom flaps (i.e., height) such that the forms are level with the fold lines of the flaps. It is undesirable to underfill the boxes because the forms will shift and wrinkle during shipment. It is likewise undesirable to overfill the box because that makes it difficult to close the top flaps without bending them above their fold lines.

Unfortunately, this ideal is difficult to meet, consistently with providing an equal number of forms in each container in a large production run of forms. The caliper of the forms paper is not constant from roll to roll and therefore the height of stacks of forms of equal number of sheets can vary significantly. This circumstance makes it very difficult to provide a constant number of forms in a single size box and yet neither underfill not overfill the box. Workmen are unable manually to compress a tall stack of forms by a substantial amount if the container is overfilled. Therefore, various measures have been adopted in an effort to deal with this problem.

One approach is to use a regular-slotted container of sufficient height to accept a stack of forms of the thickest typical caliper and then to add corrugated cardboard shims in sufficient number to fill out any containers which are underfilled by paper of thinner caliper. However, this approach is wasteful, both in the cost of using larger size boxes and in the use of substantial quantities of corrugated cardboard as shims.

Another approach is systematically to provide more sheets in each stack of forms than is specified to the customers, for example, 4,100 sheets where 4,000 sheets is specified, and to use a regular-slotted container sized to accept the median height of the stacks of forms. Substantially fewer shims are required to fill out underfilled containers. If the container is overfilled, a portion of the stack of forms is torn off and discarded to enable closing the box. However, this approach is also wasteful and substantial care must also be taken to avoid shorting the customers on the number of sheets supplied in a stack. Moreover, regardless of which approach is taken to filling the boxes, substantial labor is required manually to package the forms.

Two attempts are known to have been made to automate the boxing of forms. One system proposed to provide an infeed conveyor for infeeding a stack of forms in an infeed direction to an elevator positioned beneath mechanism for erecting and supporting a regular slotted carbon. Knockdown cartons are infed from the opposite direction to the erecting apparatus. This design called for elevating the stack of forms and at the same time lowering the carton to insert the stacked forms into the open bottom of the carton. Thereupon, a bottom-folding mechanism comprising a pair of hinged plates folds the minor bottom flaps of the carton one at a time as the elevator, constructed in two vertically divided parts, was retracted downwardly one part at a time. Then, the major bottom flaps are closed. Next, with the bottom-closing mechanism still supporting the filled carton, the carton was to be pushed in the infeed forms direction onto an outfeed conveyor spaced above the forms infeed conveyor and below the carton infeed mechanism, for closing the top flaps. This design was subsequently abandoned without testing.

A second proposal provided apparatus for erecting a regular slotted container and positioning the container beneath an elevated form-dropping mechanism. Knockdown containers are infed to a container erecting mechanism spaced a distance laterally from the dropping mechanism, on opposite sides of a low wall. During erection, the knockdown containers were oriented on their sides with their top and bottom flaps extending laterally in opposite directions. One at a time, each container is opened and its bottom flaps closed and glued. Then, the container would be flipped over the low wall to right it on a box infeed conveyor, bottom flaps down, and positioned to align it beneath the dropping mechanism.

The form-dropping mechanism includes two pairs of parallel, end-to-end abutting fingers, in the form of powdered conveyor rollers. Each set of fingers is mounted on a normal frame member laterally movable to separate the fingers lengthwise to drop the forms. A pair of walls or fences is positioned above the fingers parallel to the frame members and movable laterally to center the stack in the dropping mechanism.

Stacks of forms are infed in the opposite direction from the direction containers are input via a conveyor to an elevator to be raised, one stack at a time, to the elevation of the dropping mechanism for dropping into the underlying box. The top flaps of the container are retained in an upwardly laterally extended position so as to funnel the dropped stack of forms downward into the box. After being filled, the box is conveyed normally of stack infeed conveyor out from beneath the dropping mechanism and to a case sealer. The case sealer included a pressing mechanism in the form of separate "feet" for compressing the forms in the box and then quickly retracting to allow closure of the top flaps. The top flaps were then glued and the box discharged. Meanwhile, the stack infeed elevator is lowered to the infeed conveyor to receive another stack of forms. The case erector proceeds to erect another regular slotted container and to flip the same over the wall to be positioned beneath the form-dropping mechanism.

Such a system was constructed and operated for a time, but was never able to be made to operate satisfactorily. Use of this system also suffered from all of the above-described drawbacks of manually packaging the forms in regular-slotted containers, particularly in the requirement of a capability to insert sufficient shims to fill out an underfilled box. For these reasons and because of its very substantial cost, this design was ultimately abandoned.

Accordingly, a need remains for an effective and economical system including apparatus and method for boxing printed forms.

SUMMARY OF THE INVENTION

One object of the invention is to automate the packaging of stacked forms.

A second object is to reduce the labor required for packaging forms.

A third object is to minimize the disadvantageous effects of variations in paper thickness in boxing printed forms.

Another object is to eliminate the need to provide more than a specified number of sheets of paper in a stack of forms and to minimize the wastage of forms.

A further object is to eliminate the need for oversized containers and cardboard shims to fill unused space in the containers.

To these ends, the invention includes a method for boxing forms comprising erecting a half-slotted container, aligning the container upright beneath a dropping mechanism and dropping a stack of forms therefrom into the container. The container is sized to a height less than a predetermined height of the stack, even for forms of less than median caliper. Thus, the half-slotted container is always overfilled by at least a predetermined margin. Next, the stack is substantially compressed, such as by a pneumatic press at 1200 pounds of force, but the container is sufficiently overfilled that the compressed stack still has a height exceeding the height of the container, e.g., by a margin of ½ inch to 3 inches after compression. A telescoping lid is then applied to the container and secured, preferably in a manner that maintains the stack of forms in compression such as by strapping. The lid is sized, for example, to a four-inch depth, to fit over the excess thickness of forms, with a small overlapping margin for the maximum thickness of forms when compressed.

By compressing the stack before applying the lid, inherent bowing in the forms can be minimized to avoid wrinkling the top forms when the lid is applied. A pad can also be provided beneath the stack of forms to minimize wrinkling of the bottom sheets against the container's bottom flaps and to protect such sheets during handling by the apparatus. The container is also preferably sized to provide minimum clearance between its interior sidewalls and the sides of the stack of forms to air-cushion the stack of forms as it drops into the container.

The invention further includes apparatus which, in one aspect, comprises dropping means for dropping a stack of forms into a container receivingly positioned beneath the dropping means; accumulating conveyor means for infeeding stacks of forms to the dropping means and retaining a stack of forms thereon during operation of the dropping means; accelerating conveyor means in line with the accumulator conveyor means for infeeding a stack of forms from the accumulating conveyor means to the dropping means; and gate means between the accumulating conveyor means and the accelerating conveyor means for opening and closing a passageway to the dropping means. The accelerating conveyor means is operable at a speed greater than the speed of the accumulating conveyor means so as to space a first stack of forms apart from a second stack so that the gate means can close between the stacks to detain the second stack of forms on the accumulating conveyor during operation of the dropping means to drop the first stack into the container.

Means can be included for actuating the dropping means and means cooperable with the actuating means for opening the gate means to admit the first stack of forms to the dropping means and then to close the gate to exclude the second stack of forms until the first stack is dropped.

In another aspect of the invention, the infeeding means for infeeding stacks of forms to the dropping means is preferably fixed at the same elevation as the dropping means. The stack and container infeed means are preferably arranged within the first over the second to infeed in the same direction.

Means for discharging the container, after filling with forms, should also be aligned with the second infeeding means for discharging in the same predetermined direction.

The apparatus can include erecting means for erecting a container at an infeed end of the receiving position, means for infeeding an erected container to the receiving position, and top guide means for guiding the container into said guideway. Preferably, the top guide means, form guide means and guideway defining means are interconnected and include means for vertical adjustment thereof as a unit.

The discharging means can include elevator means for lowering the filled container relative to the dropping means so as to provide vertical clearance between the stack of forms and the dropping means for discharge of a first container and raising to receive a second container from the second infeeding means.

Sensor means can be positioned at a discharge end of the container-receiving position for sensing the presence of a box in said position and the discharge of a box therefrom to control actuation of the container infeeding means. Means responsive to the sensor means can be provided to control the second infeeding means so as to stop infeeding the container in said predetermined direction when a first end of the container is aligned beneath an end of the dropping means so as to center the container along said direction beneath the dropping means.

The apparatus can further include first means for sensing the presence of a stack in the dropping means; second sensing means for sensing the presence of a container in the receiving position; and means jointly responsive to said first and second sensing means for actuating the dropping means only when containing a stack of forms and a container is in the receiving position. Moreover, such apparatus preferably includes means positioned at an infeed end of the receiving position, beneath the first infeed means, for erecting a container; third sensing means for sensing the presence of an erected container at said infeed end of the receiving position; and means jointly responsive to the second and third sensing means for actuating the second infeeding means upon sensing the absence of a container in the receiving position and the presence of an erected container at said infeed end.

The control means can also be responsive to the third sensing means sensing absence of an erected container for actuating the container erecting means.

The foregoing and other objects, features and advantages of the invention will become more readily apparent from the following detailed description of a preferred embodiment of the invention, which proceeds with reference to the accompanying drawings.

BRIEF DESCRIPTION OF DRAWINGS

FIG. 13 is a perspective view in the direction of arrow 13 in FIG. 1 showing the box-receiving conveyor and guides and outfeed conveyor in a lowered condition for discharging a filled box of forms.

FIG. 14 is an exploded view of the apparatus of FIG. 13 showing the conveyors and box in an elevated position preparatory to receiving and filling a box with forms.

FIG. 15 is a fragmentary perspective view of the actuation system used in the apparatus of FIG. 1.

FIGS. 16*a*–16*c* are schematics of the electrical circuit for controlling the electric motors and pneumatic actuators of the apparatus of FIGS. 1–15.

DETAILED DESCRIPTION

General Arrangement

Figure 1:
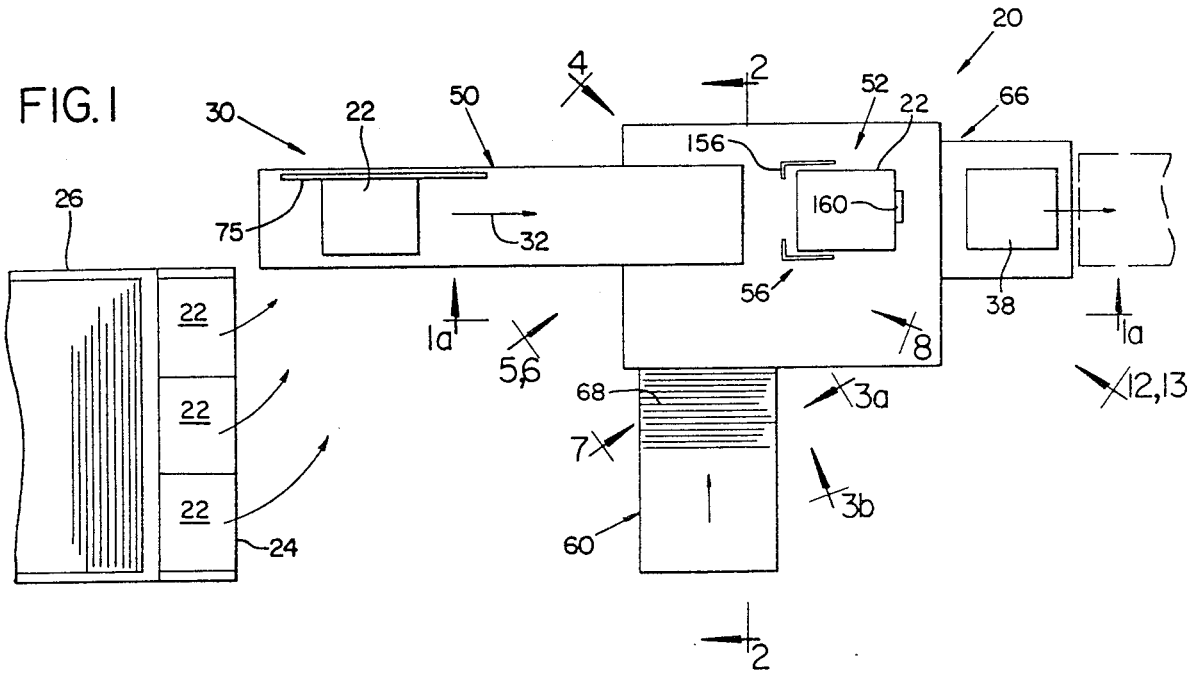
FIG. 1 is a top plan view of a schematic of a system for boxing printed forms in accordance with the invention.
Figure 1A:
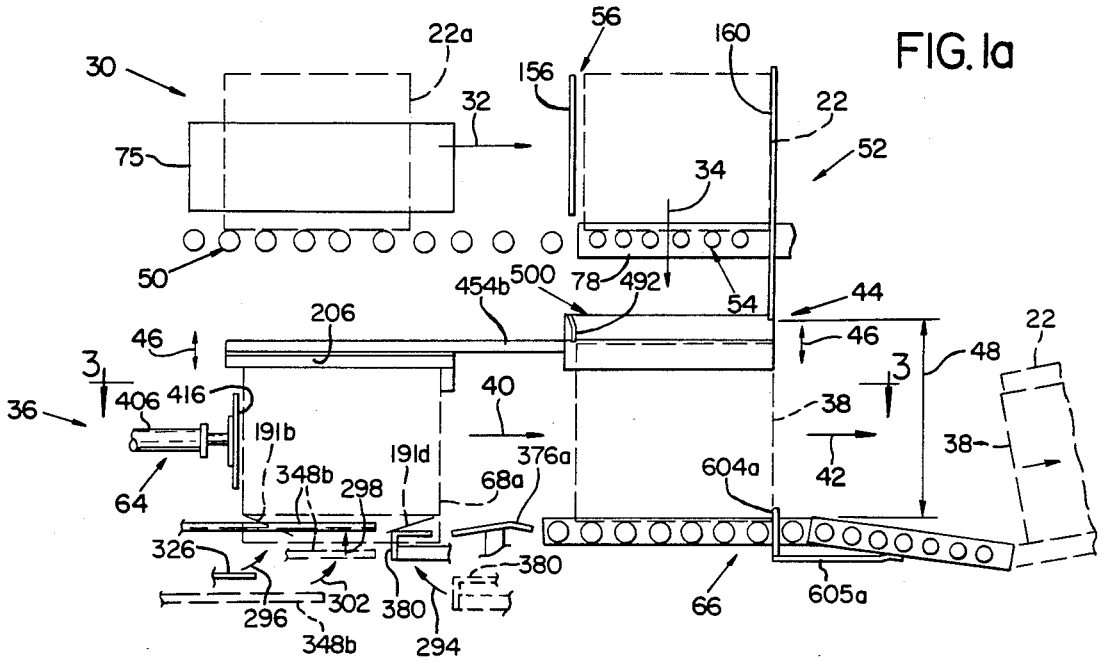
FIG. 1*a* is a schematic side elevational view taken along lines 1*a*—1*a* in FIG. 1.

Referring to FIGS. 1 and 1A, a forms boxing apparatus 20 in accordance with the invention is used to package stacks of forms 22 assembled on an outfeed tray 24 of conventional form-printing, cutting and accordion-folding apparatus 26. The principal elements of apparatus 20 are a forms infeed and dropping subsystem 30, in which forms are moved in a predetermined direction indicated by arrow 32 and subsequently dropped as indicated by arrow 34, and a container erection, receiving and discharge conveyor subsystem 36, spaced below and aligned with subsystem 30 so as to move the containers in the same direction, indicated by arrows 40, 42. A guide structure or framework 44 provides an interface between subsystems 30 and 36 which is vertically adjustable, as indicated by arrows 46, to accommodate containers of different heights of up to a maximum height 48.

Figure 11:
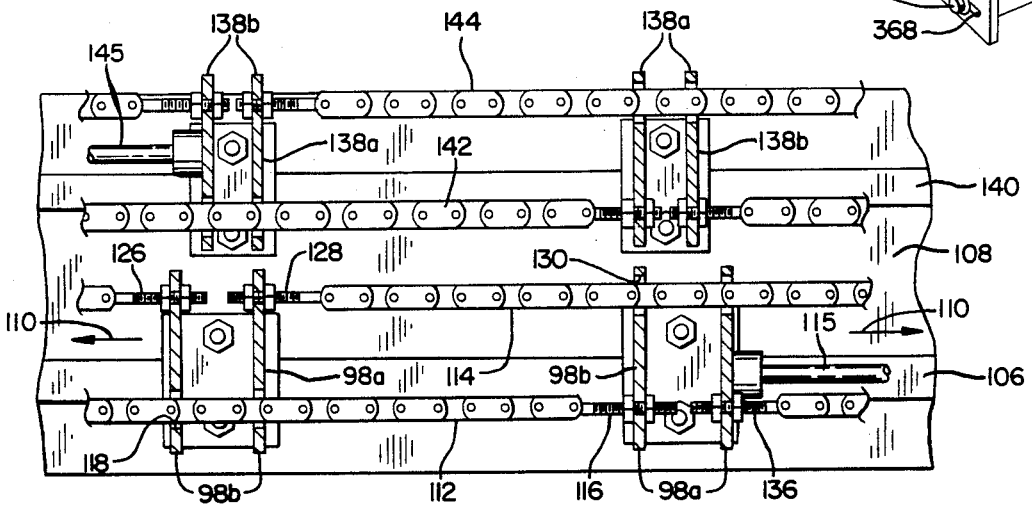
FIG. 11 is a cross-sectional view taken along lines 11—11 in FIG. 9.

Breaking the foregoing subsystems down, subsystem 30 comprises an accumulator conveyor 50 and a dropping mechanism 52 (further detailed in FIGS. 9–11) for dropping stacks of forms one at a time into a container receivingly positioned beneath conveyor subsystem 30. The dropping mechanism includes an accelerating conveyor 54 and a gate arrangement 56 cooperable with conveyors 50, 54 to detain one or more stacks of forms on the accumulator conveyor while one stack 22 is being dropped by the dropping mechanism and then to accelerate the next succeeding stack 22*a* and thereby space it from subsequent stacks (not shown) to provide a gap for closure of the gate to admit one stack at a time into dropping mechanism 52.

Figure 2:
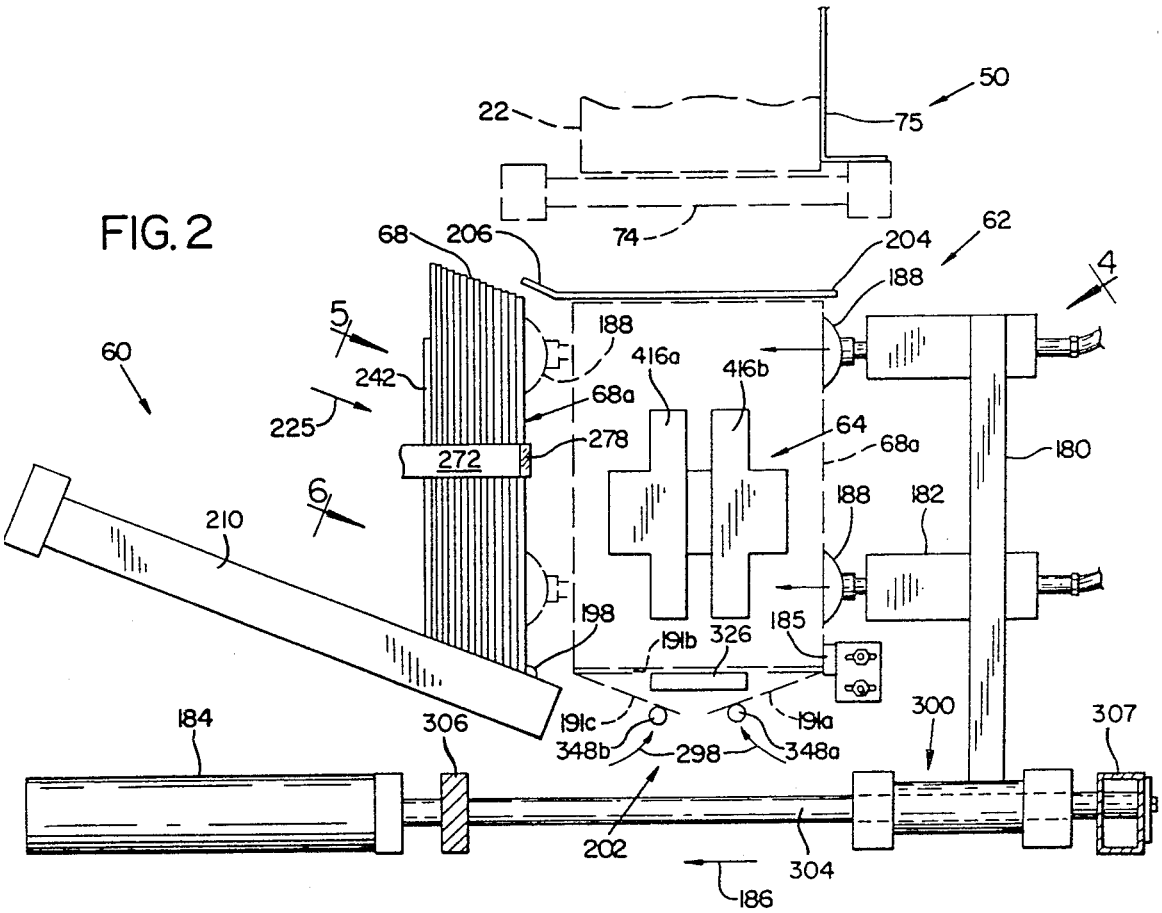
FIG. 2 is a schematic sectional view taken along lines 2—2 in FIG. 1.
Figure 3:
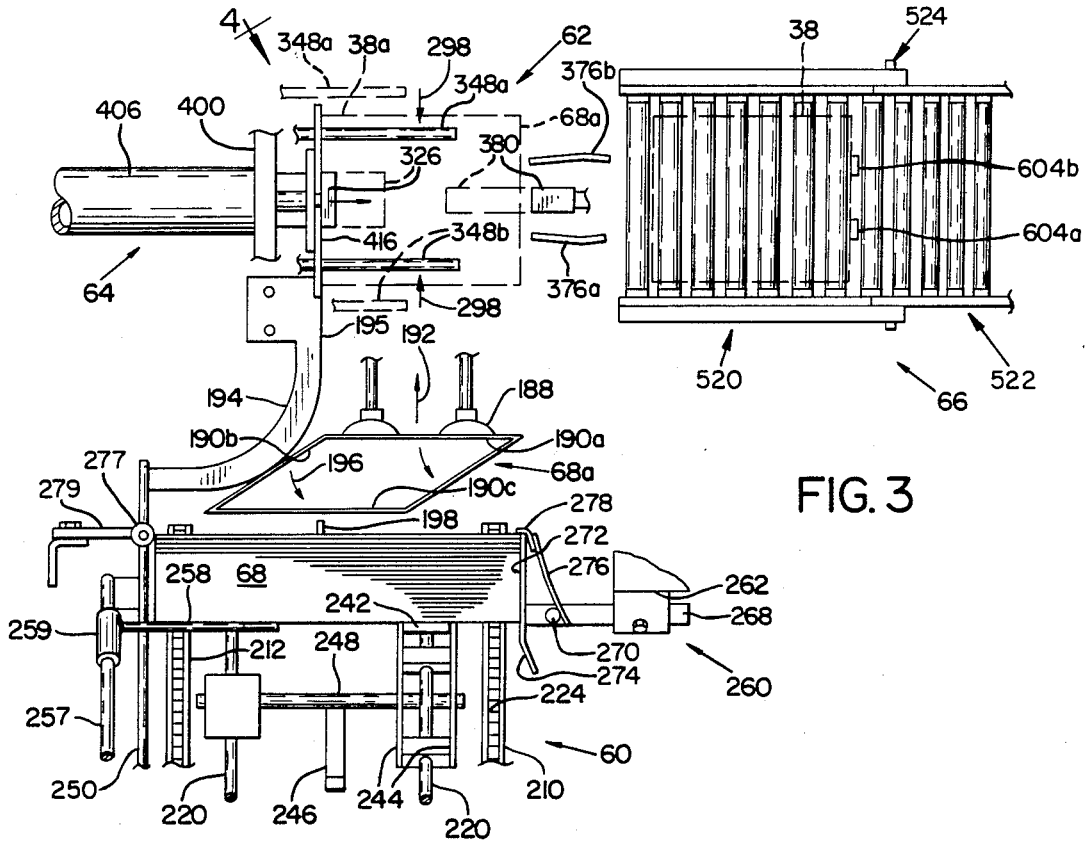
FIG. 3 is a horizontal sectional top plan view of the apparatus shown in FIGS. 1*a* and 2, taken along lines 3—3 in FIG. 1*a*.

Referring generally to FIGS. 2 and 3, the container erecting, conveying and discharge subsystem 36 includes a knockdown container infeed tray (detailed in FIGS. 3*a* and 3*b*) or magazine 60, a container erection mechanism 62 (FIGS. 4, 6 and 7), a container infeed or pusher 64 (FIG. 5) and a receiving and discharge conveyor assembly 66. Subsystems 30, 36 are spaced vertically apart by the supporting framework (shown fragmentarily in FIGS. 4–7 and 15) of apparatus 20 by a predetermined distance 48 sufficient to accommodate half-slotted containers of up to a predetermined height. Framework 44 is vertically adjustable within that distance to accommodate containers of lesser height. The space beneath framework 44, generally outlined by container 68*a* in FIG. 2, is referred to as the container infeed passageway.

Electrical, pneumatic and motor actuation and control subsystems, discussed hereinafter with reference to FIGS. 15 and 16, orchestrate the operation of the foregoing subsystems to infeed one stack at a time to the dropping mechanism, to infeed a carton to the receiving conveyor and actuate erection of another carton, to actuate dropping a stack of forms into the carton on the receiving conveyor, to lower the receiving conveyor and provide clearance or head room between the top of the forms and the guide interface 44, to discharge the filled container of forms and return the receiving conveyor to a raised position, and then repeat the foregoing procedure as soon as the next container and stack of forms are in the receiving position and dropping mechanism respectively. Containers are erected from knockdown cartons 68.

Each of the above-mentioned subsystems is described in turn hereinafter, followed by a description of set up and operation of the system as a whole.

Forms Infeed and Dropping Subsystem

Figure 9:
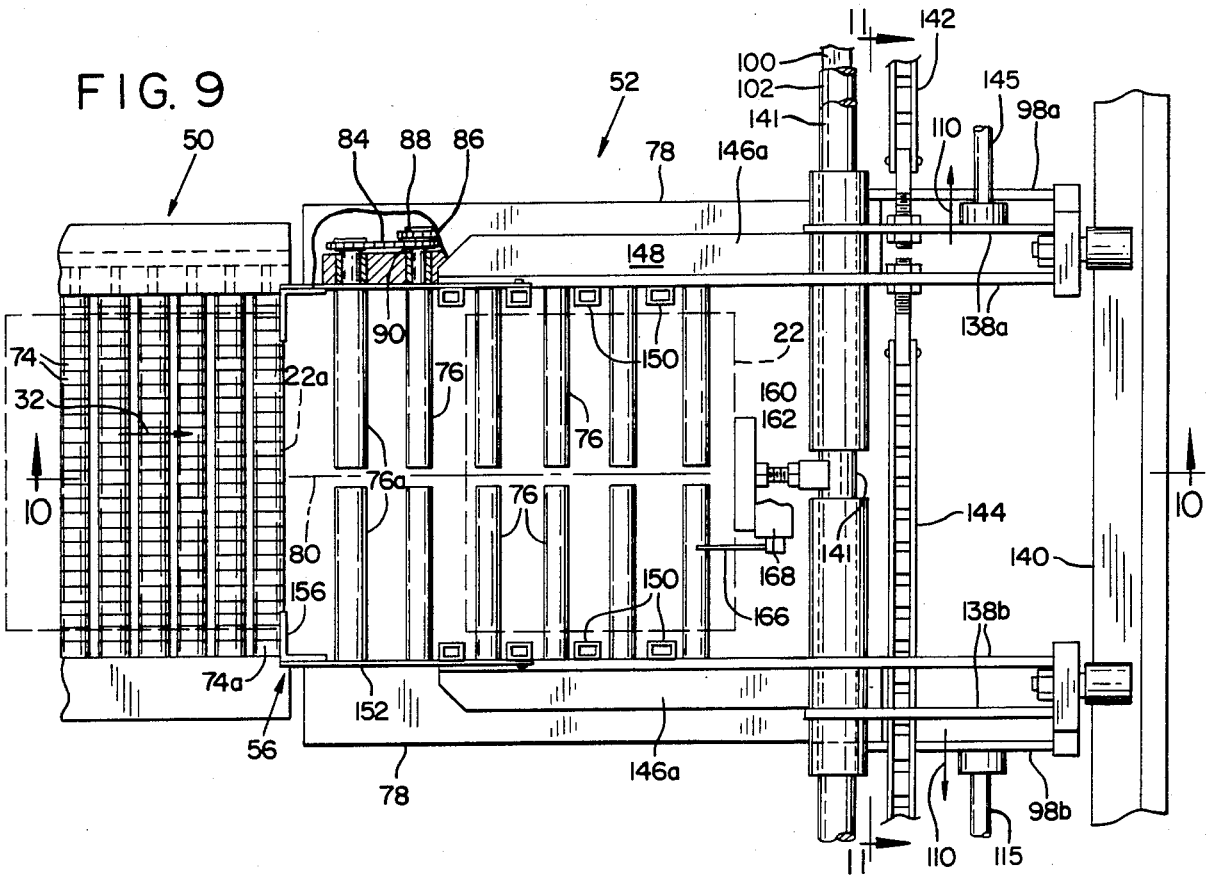
FIG. 9 is a top plan view of the forms dropping portion of the apparatus of FIG. 1 as viewed along lines 9—9 in FIG. 1*a*.
Figure 10:
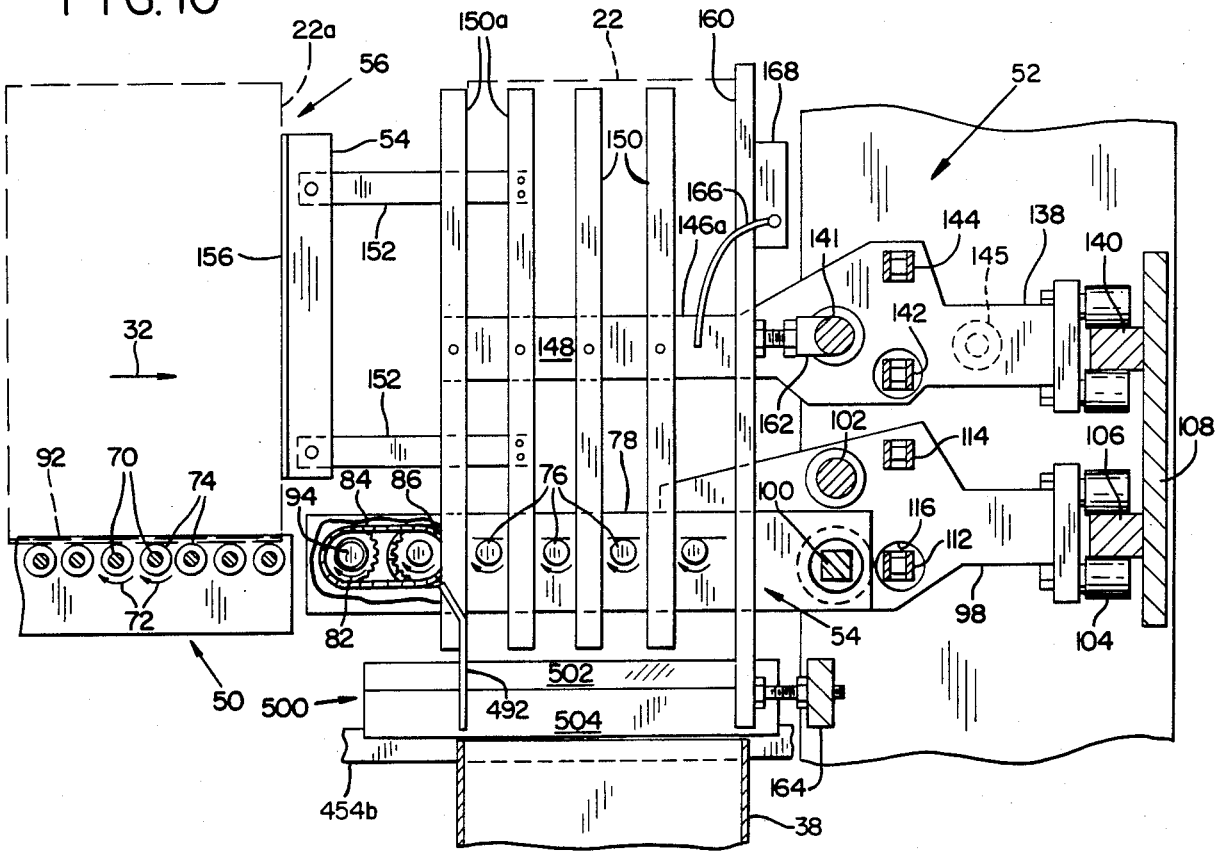
FIG. 10 is a cross-sectional view taken along lines 10—10 in FIG. 9.

Referring to FIGS. 9 and 10, accumulator conveyor 50 is a friction roller-type conveyor such as the SLIP TORQUE accumulating conveyor system manufactured by Shuttleworth of Huntingdon, Ind. Such a conveyor has continuously rotating roller shafts 70 which are driven by motor 71 (FIG. 5) to rotate in the direction of arrow 72 all at the same speed. A plurality of annular disks 74 is mounted on each shaft and sized to an inner dimension to loosely frictionally engage a shaft so as to rotate with the shaft unless restrained.

Aligned with the accumulating conveyor is accelerating conveyor 54, comprising two rows of end-to-end, nearly abutting parallel horizontal live roller fingers 76. Each row of fingers is mounted in mirror image relationship on a horizontal frame member 78, at a right angle thereto. The fingers are individually journaled for rotation at their lateral ends in their respective frame member, are free at their medial ends, and are opposed in pairs and spaced a short distance apart about a centerline 80 between the sides of the conveyor. As indicated by arrows 82 in FIG. 10, finger rollers 76 are rotated in the same direction as accumulator roller shafts 72, but at a greater speed of rotation by a series of interconnecting chains 84, 86, connected to sprockets 88, 90 mounted on the journaled ends of the roller fingers and housed within frame members 78. The outer surfaces of the roller fingers are formed of a smooth metal so as to slip easily on a pad 92 positioned under the bottom sheet of the stack of forms when the stack is restrained. However, the opposed pair of rollers **76*a* located nearest the accumulator conveyor is provided with a latex or other highly frictional sleeve 94** for promptly accelerating each stack of forms as it enters the dropping mechanism.

The side frame members 78 of the dropping mechanism are supported by spreading arms **98*a*, 98*b*. These arms are in turn supported for laterally slidable movement on rod 102, connected at its lateral ends to the supporting frame (not shown), and by a pair of rollers 104 received on a track 106 extending horizontally across a frame plate 108. Just below rod 102, a square shaft is slidably received in a drive sprocket in the proximal end of member 78. This shaft is driven by a motor 99 through gear box 100 (FIG. 15). The dropping mechanism is opened by moving frame members 78 laterally, as indicated by arrows 110. This action is performed by a pair of roller chains 112, 114, best seen in FIG. 11. Chain 112 is connected at one end to a lower portion of bracket 98*a*, extends through an opening 118 in a lower portion of bracket 98*b* and around a drive sprocket (not shown) mounted on the frame and back to another bolt 126 connected to an upper portion of bracket 98*b*. A second bolt 128 axially aligned with bolt 126 connects chain 114 to the upper portion of bracket 98*b* and such chain extends through an opening 130 in the upper portion of bracket 98*a* around the drive sprocket mounted in similar fashion on a second pusher to connect by means of bolt 36 back to the lower portion of bracket 98*a*. A pneumatic ram 125, supported by the frame (FIG. 15), is connected to arm 98*b* to open and close conveyor 54** to drop the forms.

Mounted above arms 98, in similar fashion, is a second pair of spreading arms 138 supported on a shaft 141 and by rollers on a runner 140. These arms are interconnected by a pair of chains 142, 144 in the same form and manner as chains 112, 114, and likewise connected to a pneumatic actuator 145 for opening and closing a pair of centering walls **146*a*, 146*b*, independently of dropper conveyor elements 76, 78. Each wall is formed by an angle member 148 extending horizontally in the direction of the accumulating conveyor from members 138 and supporting four vertical, spaced upright members 150**.

Connected to the upright members **150*a* nearest the accumulating conveyor, are a pair of vertically-spaced horizontal extensions 152, to the ends of which are connected a pair of angle members oriented vertically and with one leg 156 extending medially to define gate 56 substantially in alignment with the end set of friction rollers 74*a* (FIG. 9) in the accumulator conveyor. When centering walls 146 are opened, gate 56 opens; when they are closed, to center a stack of forms on top of the floor of the dropping mechanism, that is, on rollers 76, the gate closes to detain any subsequent stack 22*a* on the accumulating conveyor until stack 22 has been dropped and the roller fingers have been moved medially back to a closed position, as shown in FIG. 9. Thereupon, a control and actuation system, described hereinafter, opens the centering walls 146 at gate 56** to admit the next stack of forms.

As the next stack is moved by rollers 74 into contact with the first pair of finger rollers **76*a*, the highly frictional surface of such rollers engage and accelerate the incoming stack onto the remaining finger rollers 76**.

A vertical member or stop 160 is supported at the downstream end of the dropping mechanism by means of an adjustable bracket 162 on rod 141 and a second adjustable bracket 164 positioned at a lower end of stop 160. As soon as the next stack **22*a* contacts stop 160, the bare metal rollers 76 begin to slip beneath the stack. Just prior to contacting stop 160, the front or downstream end of the stack contacts a cat whisker 166 and accordingly actuates sensor 168 which is connected to the control system of FIGS. 15 and 16 to cause the centering walls to close. This action also closes gate 56 to detain the next succeeding stack, left behind when the incoming stack was accelerated by finger rollers 76**.

Container-Erecting Subsystem

1. Knockdown Container Infeed Arrangement

Referring to FIGS. 2 and 3, as mentioned above, container feed tray 60 provides a stack of knockdown containers 68 standing on edge alongside the container infeed passageway to receiving conveyor 66. Continuing in general terms, each time another container is needed, box-erecting mechanism 62, comprising a vertically-oriented rectangular rack 180 supporting four rectangularly-positioned vacuum or sucker assemblies 182, is moved transversely across the aforementioned passageway by pneumatic cylinder 184 in the direction of arrow 186 to tray 60. Upon contacting knockdown carton 68*a* nearest the passageway, vacuum cups 188 in the suction assembly engage carton 68*a* on major panel 190*a*. Then, referring particularly to FIG. 3, the control system of FIGS. 15 and 16 causes actuator 184 to reverse direction, as indicated by arrow 190 to pull knockdown container 68*a* away from the stack 68.

Figure 5:
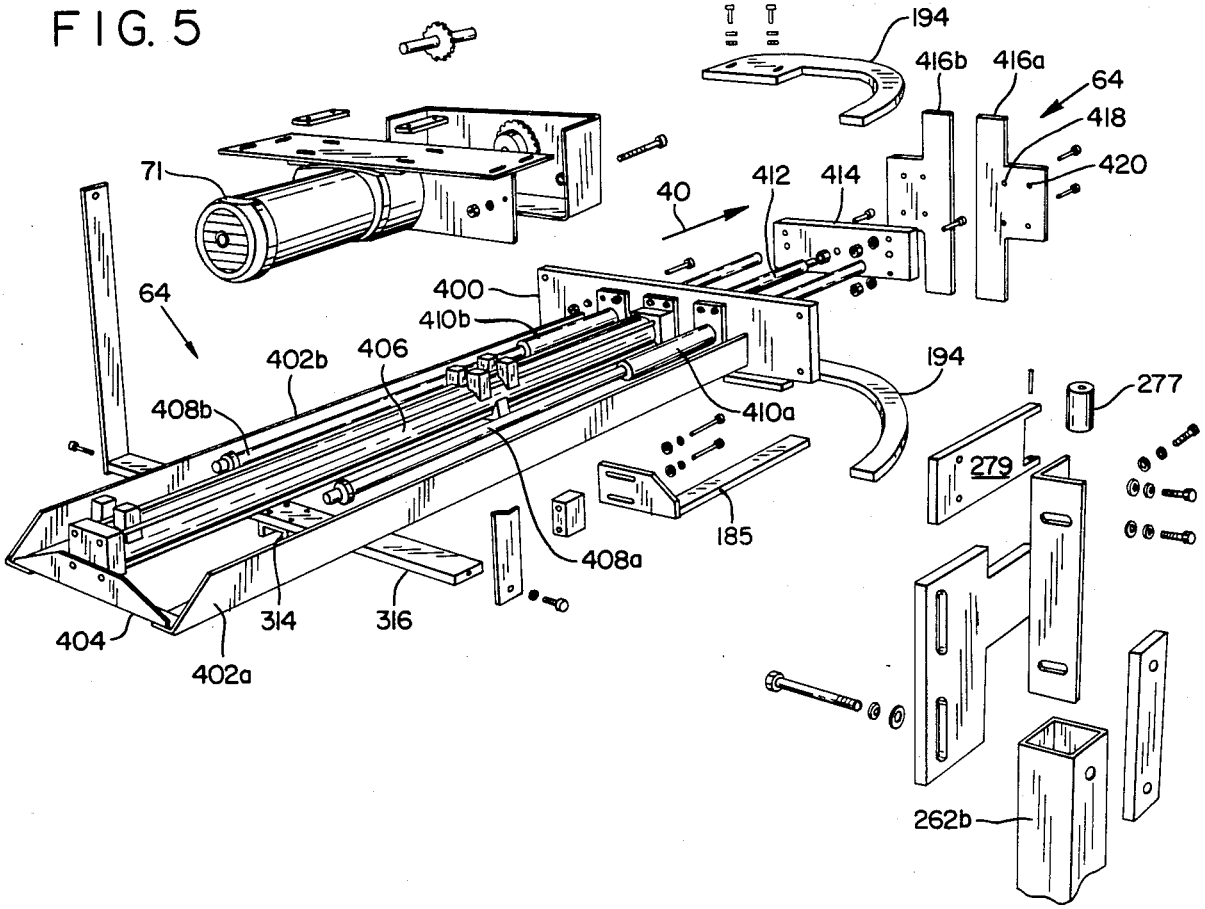
FIG. 5 is a detailed perspective view of the box pushing mechanism of FIGS. 1*a* and 2, as viewed along arrow 5 in FIGS. 1 and 2.

A pair of arcuate members 182, also shown in FIG. 5, are connected to the frame of machine 20 adjacent an upstream end of the container infeed passageway, between pusher 64 and tray 60 cammingly to engage minor panel 190*b* of the container. This action causes the remote side of the container to move transversely of the direction of arrow 192, as indicated by arrow 196, to open the container into a parallelogram and then ultimately into a rectangle, as the assembly 180 moves across the infeed passageway. This action is assisted by a hook 198 extending from the underside of tray 60 at the lower edge of containers 68. The lower margins of containers 68 are vertically slotted to define the bottom flaps of the container, and the container is rectangular so that the major flaps 191*a*, 191*b* are longer than the minor flaps 191*b*. Accordingly, hook 198 is offset from the center of the stack of knockdown cartons 68 toward arcuate member 194 so as to align with the slot (not shown) between major flap 191*a* and minor flap 191*b*. Consequently, the hook extends through the slot to contact the major flap 191*c* to hold it back against stack 68 while the vacuum assembly 62 is drawing panel 190*a* across the passageway to open the container in an upright position. Once the container is fully opened, major flap 191*c* bends slightly on its fold line to release from hook 198 while the contacting surface 195 of members 194 maintains the carton in a rectangular configuration.

As it is opened, the knockdown carton is pulled into the container infeed passageway. There, it contacts a sensor 200 (FIG. 2) which actuates a bottom-closing mechanism 202*a*, 202*b*, described hereinafter with reference to FIGS. 6 and 8. As the container is drawn across the passageway by the vacuum assembly and when it is subsequently infed to the receiving conveyor, it is guided along its upper edges by a flat plate horizontally positioned beneath conveyor 50 and having an upwardly inclined lip extending along the upper edge of cartons 68. Once the bottom flaps of the container are closed, they resiliently bias the container upward against the plate. Plate 204 is a part of guide framework interface 44, which is described in further detail hereinafter with reference to FIG. 12.

2. Container Feed Tray Assembly

Figures 3A, 3B:
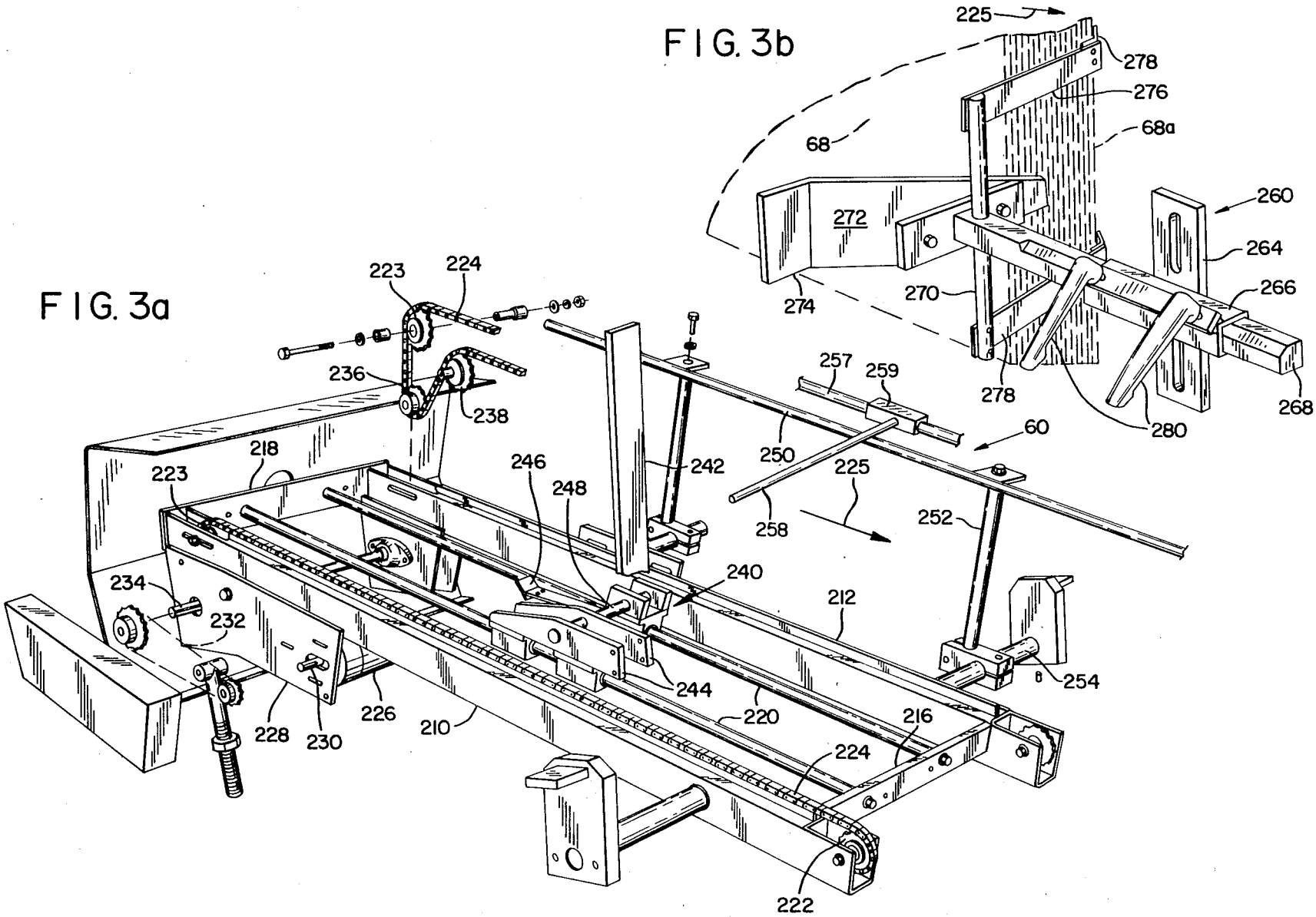
FIG. 3*a* is a detailed perspective view of the folded boxing feed mechanism of FIGS. 2 and 3, as viewed in the direction of arrow 3*a* in FIG. 1.
FIG. 3*b* is a detailed perspective view of the folded box guide used in the feed mechanism of FIGS. 2 and 3, as viewed in the direction of arrow 3*b* in FIG. 1.

Referring to FIGS. 3, 3*a* and 3*b*, the folded container feed tray 60 is oriented normal to the infeed passageway and inclined downwardly toward it. Tray 60 comprises a pair of parallel rectangular structural members 210 interconnected at each end by perpendicular flat members 216, 218, a pair of parallel cylindrical guide rods 220 are spaced between members 210, 212 and connected at their ends to members 216, 218. Optionally, for higher speed operation (more than about 15 containers per minute), a sprocket 222 is mounted in each end of each of the rectangular members 210, 212 for supporting feed roller chains 224 in each such members. A drive motor 226 is mounted on a panel 228 depending from the lateral side of member 210 and has an output shaft 230 connected to a chain 232 and a pair of sprockets to a drive shaft 234 which extends across the tray beneath members 210, 212 and normal thereto. Sprockets 236 (see fragmentary view in upper center portion of FIG. 3*a*) mounted on shaft 234 beneath of each members 210, 212 drive the two chains 224 around an idler pulley 238. For lesser operating speeds (10–15 containers per minute or less), this drive roller chain arrangement can be omitted.

A container backer or sliding "book-end" assembly 240 includes a flat upright member 242 connected at its lower end between plates 244 for engaging a backside of the stacked knockdown containers to hold them upright. Assembly 240 is slidably mounted on shafts 220 to support knockdown containers in a generally vertical position, with their lower edges resting on chains 224. This assembly travels behind the containers under force of gravity as containers are used. It can be slid back toward the motor end of the tray and latched by spring catch 246 on member 218 to add more boxes to the tray. Sliding outrigger 248 laterally stabilizes assembly 240.

A first rail 250 is mounted along the remote or upstream side of tray 60 for aligning the adjacent corners of the knockdown containers parallel to members 210, 212. Such rail is supported by a pair of upright members 252, each adjustably connected to a cylindrical leg 254 extending laterally from member 212 and normal thereto. To substitute for assembly 240 while adding more containers to the tray, a radial member 258 mounted on a sleeve 259 is slidably received on a second shaft 257.

Figure 7:
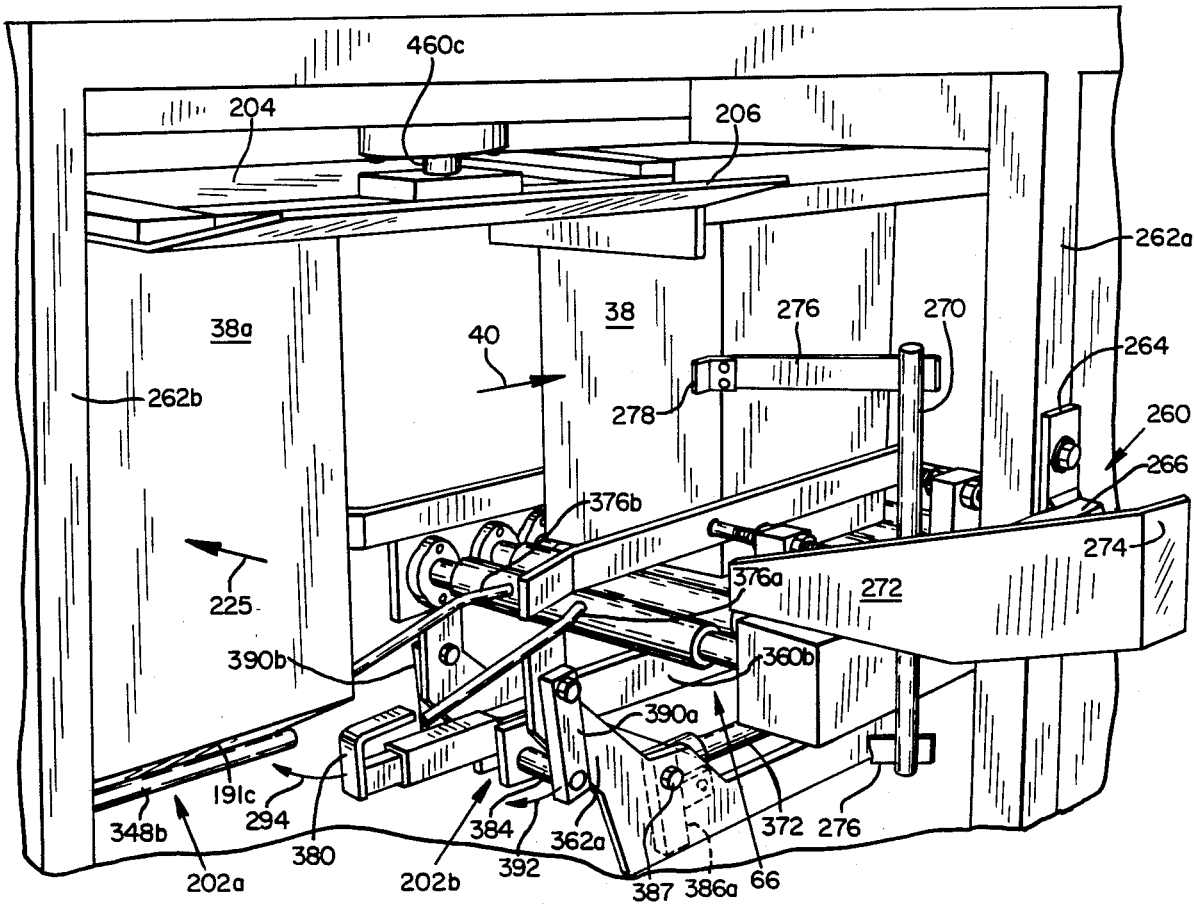
FIG. 7 is a detailed perspective view along arrow 7 in FIG. 1 of a second portion of the bottom-closing mechanism and box-receiving conveyor, with containers positioned in the container infeed passageway and on the receiving conveyor.

On the downstream side of the tray, that opposite rod 250, a second alignment guide 260, shown in FIGS. 3, 3*b* and 7, is mounted on the downstream side of the rectangular framework 262 surrounding the opening into the infeed passageway through which the containers are infed from tray 68. Guide 260 comprises a vertically-adjustable bracket 264 mounted on frame member 262*a* mounting a sleeve 266 oriented to receive a shaft 268 for sliding movement in a horizontal direction normal to tray frame members 210, 212 and thereby within the plane of the knockdown containers. A vertical member 270 is connected to the end of shaft 268 nearer the cartons. A generally triangular guide plate 272 is mounted on member 270 in a plane normal to shaft 268 for aligning the downstream edges of the containers. Plate 272 has an end portion 274 inclined away from the plane of the corners of the cartons to aid in aligning the cartons in camming action.

Mounted at the upper and lower ends of member 270, above and below member 272, are a pair of resilient fingers extending generally toward the direction that containers move when entering the infeed passageway, as indicated by arrow 225, and biased toward the containers. Fingers 276 each have a stop or hook 278 at the distal end thereof for engaging the downstream edge of the innermost container 68*a*. The opposite, upstream edge of container 68*a* is releasably retained by a roller 277 mounted on a plate 279 (FIGS. 3 and 5). Set screws with handles 280 fix the position of shaft 268 in sleeve 266. When it is desired to change to containers of a different size, such set screws are loosened and shaft 260 is moved toward or away from the cartons as needed for smaller or larger cartons, to keep the upstream corners of the cartons always in the same position relative to alignment rod 250 and thereby relative to arcuate members 194.

3. Vacuum Container Opening Mechanism

Figure 4:
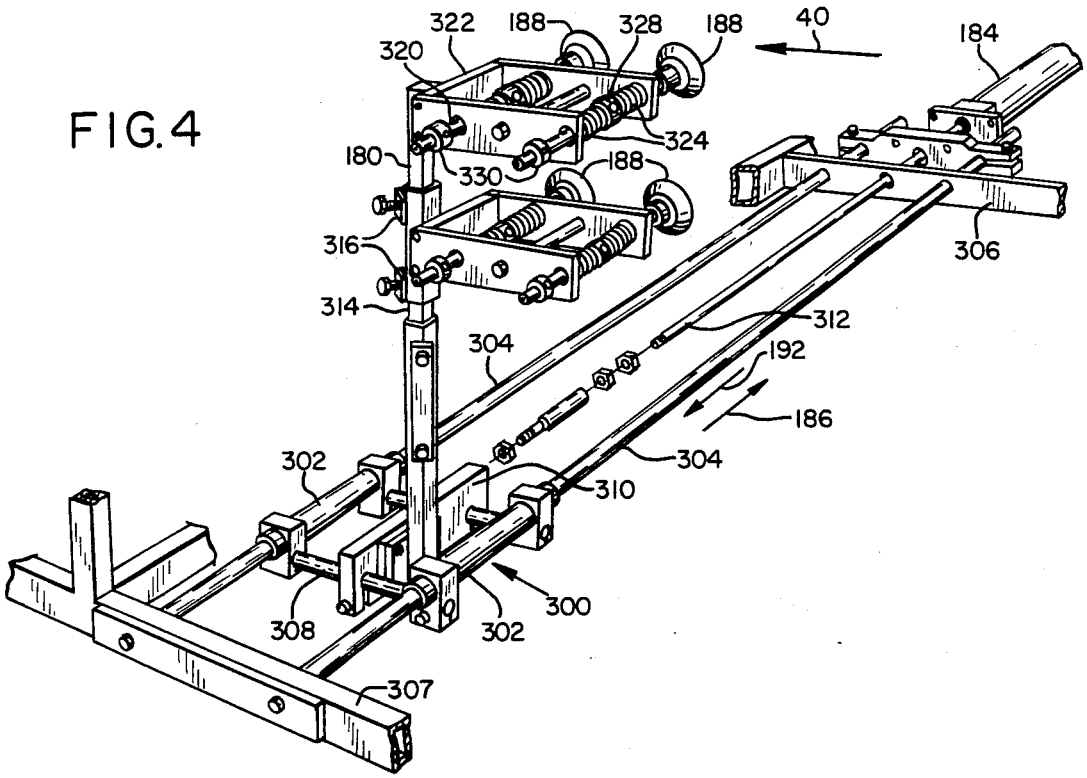
FIG. 4 is a detailed perspective view of the box opening mechanism of FIG. 2 as viewed in the direction of arrow 4 in FIGS. 2 and 3.

Next, referring to FIG. 4, it can be seen that opening mechanism 180 is carried on a framework 300 including a pair of sleeves 302 slidably received on a pair of parallel rods 304 connected to opposite side frame members 306, 307 of the machine 20 and extending normal to such side frame members and to the direction of infeed of erected cartons, indicated by arrow 40. Extending between sleeves 302 are a pair of perpendicular cross members 308, which are in turn interconnected by a flat member 310 spaced between sleeves 302 and connected parallel to the sleeves to a ram 312 of pneumatic cylinder 184. Mechanism 180 is mounted by means of vertically-adjustable sleeves 316 on a vertical standard 314. Connected to member 310, two U-shaped brackets 322 are vertically spaced on standard 314. Vacuum cups 188 are each mounted on a hollow shaft 320 and the shafts are slidably mounted in parallel spaced relationship in openings in opposite sides of the U-shaped brackets. Two coil springs 324 are received on each tubular member between the sides of the bracket, separated by a collar 326 fixed to tube 320, in effect to spring-load the tubular shafts. A second collar 330 is mounted on the end of each shaft remotely of vacuum cup 188. Tubes 320 are connected by long, flexible vacuum hoses to a vacuum pump 622 (FIG. 15) or other suitable source of subatmospheric pressure operable by the control actuation system of FIGS. 15 and 16 to apply a vacuum at cups 188 each time a new container is retrieved from the knockdown container tray, and to maintain such vacuum to hold an erected carton "on deck" until it is time to push the next carton to the infeed passageway to the receiving conveyor (see lines 39 and 40 of FIG. 16*b*).

4. Bottom Tucker Assemblies

Figure 6:
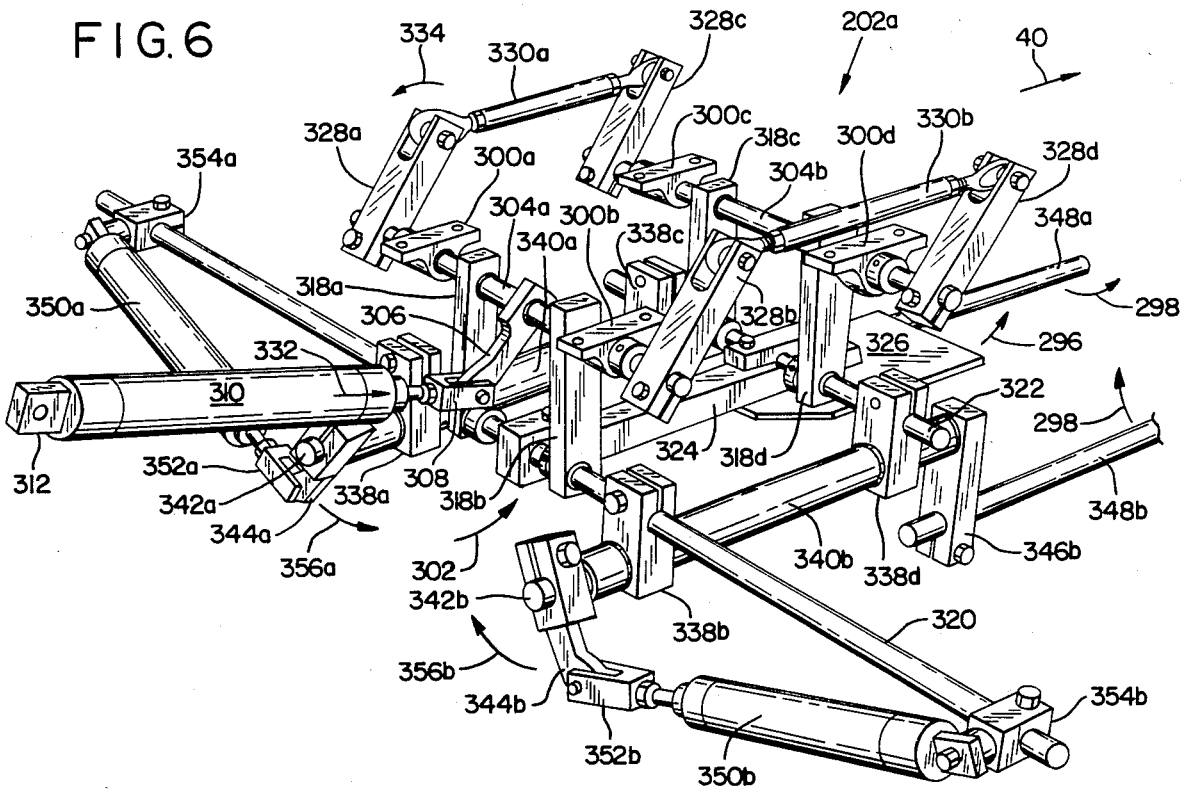
FIG. 6 is a detailed perspective view of the bottom-closing mechanism of FIG. 2, as viewed along arrow 6 in FIGS. 1 and 2.
Figure 8:
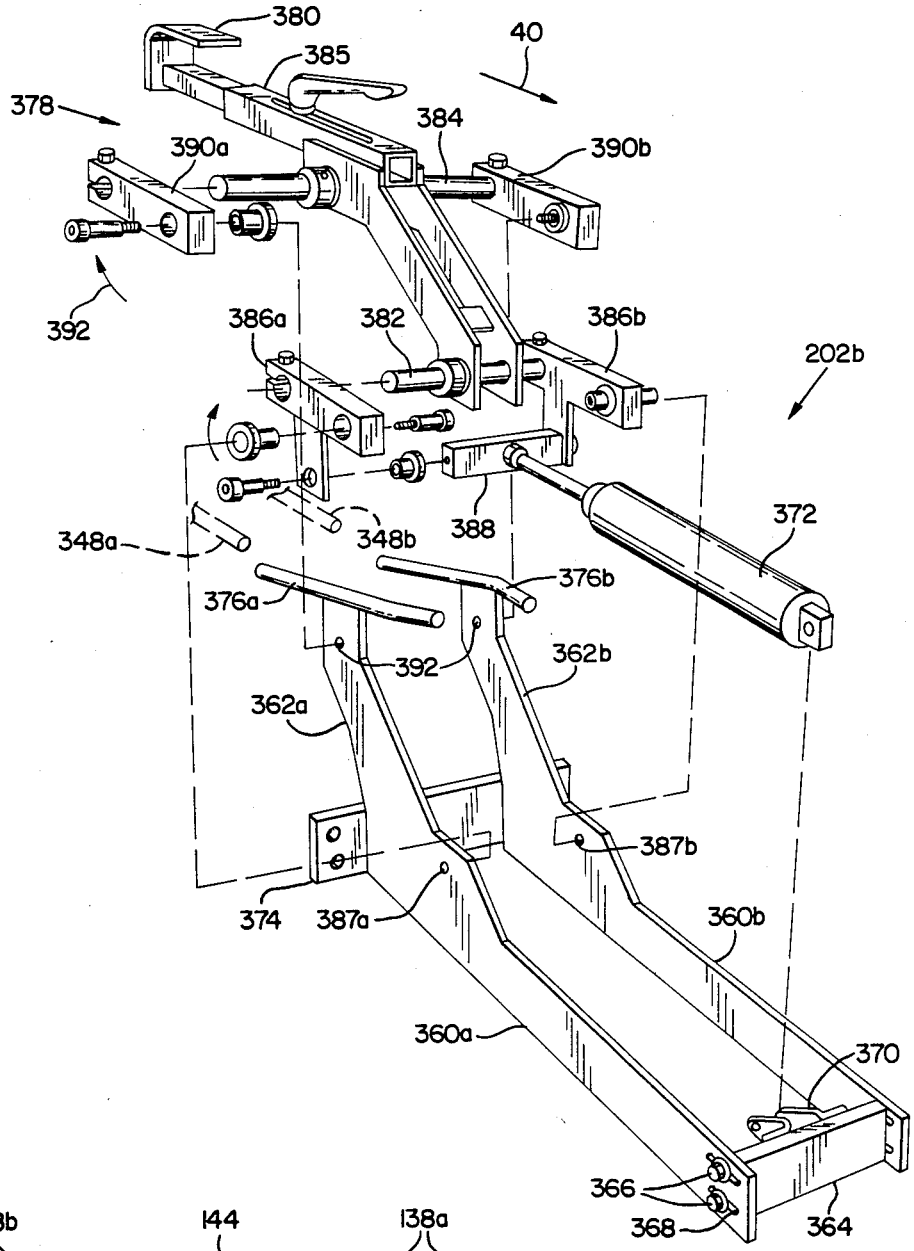
FIG. 8 is an exploded perspective view of the bottom-closing mechanism shown in FIG. 7, as viewed in the direction of arrow 8 in FIG. 1.

Next, referring to FIGS. 6, 7 and 8, following transversal of the passageway by the container opening mechanism 180, tucker apparatus 202*a*, 202*b* first close the leading and trailing minor flaps 191*b*, 191*d* of each carton, as indicated in FIG. 1*a* by arrows 294, 296, respectively. Then, apparatus 202*a* closes the two major flaps 191*a*, 191*c*, as indicated by arrows 298 in FIGS. 2, 3 and 6, and hold them in place until the container is infed by pusher 64.

Referring to FIG. 6, the trailing minor and major flap tucker 202*a* is suspended by means of four brackets 300*a*–300*d* from the framework of apparatus 20 beneath pusher 64 and is generally arranged to move in a swinging motion lengthwise of the infeed passageway during operation, as indicated by arrow 302. As shown in FIG. 1*a*, this arrangement spaces the tucker apparatus out of the way below the path of the containers during opening but moves it close to the bottom, the container once fully opened to close the bottom flaps.

Brackets 300*a*, 300*b* are spaced apart and support a transversely extending shaft 304*a*. Brackets 300*c*, 300*d* are similarly spaced apart and at a distance in the infeed direction 40 from brackets 300*a*, 300*b* so that the four brackets altogether define a rectangle, and likewise support a shaft 304*b* extending parallel to shaft 304*a*. A pusher arm 306 is connected radially to shaft 304*a* midway between the two supporting brackets and extends downwardly and rearwardly at an inclination to a connection 308 on the ram of a pneumatic cylinder 310. This cylinder, referred to hereinafter as the trailing minor flap tucker, is connected at its rear end 312 to a bracket 314 supported on a transverse frame member 316, as shown in FIG. 5.

Depending generally vertically from each shaft 304 are a pair of support arms 318*a*–318*d*, equidistantly spaced apart about arm 306 between support brackets 300. An elongated cylindrical shaft 320 parallel to shaft 304*a* is received through the lower ends of arms 318*a*, 318*b*. Similarly, a short cylindrical shaft 322 is pivotally supported by arms 318*c*, 318*d*. Centered between arms 318 is a flat member 324 extending normal to shafts 320, 322 and parallel to infeed direction 40. A flat, spade-like plate member 326 is connected in a horizontal orientation to the underside of member 324 at the downstream end thereof, that is, beneath shaft 304*b*. Plate 326 has a downstream end normal to member 324 for engaging the trailing or upstream minor flap of a container during folding of same.

Shafts 304 are rotatably interconnected by a linkage comprising arms 328*a*–328*d*, each mounted on an end of one of the shafts in parallel relationship to actuation arm 306 but extending in the opposite direction therefrom. A tie rod 330*a* extends parallel to member 324 between the distal ends of arms 328*a*, 328*c*. A second tie rod 330*b* similarly interconnects the distal ends of arms 328*b*, 328*d*. Upon actuation of cylinder 310 to extend its ram in a direction of arrow 332, shaft 304 and arms 328*a*, 328*b* are rotated in the direction of arrow 334. Arms 328*c*, 328*d* rotate in the same direction, causing the entire structure depended from shafts 304 by means of arms 318 to swing as indicated by arrow 302. This action causes plate member 326 to move in the direction of arrow 40 and upwardly, as indicated by arrow 296, to close the trailing minor flap 191*b* of an opened container positioned in the infeed passageway.

Mounted on shafts 320, 322, laterally outward of arms 318, are brackets 338*a*–338*d*, which depend vertically downwardly from their respective shafts. Brackets 338*a*, 338*c* support a sleeve 340*a* which extends parallel to member 324. A second such sleeve 340*b* is supported between brackets 338*b*, 338*d*. Received in each sleeve is a rotatable shaft 342*a*, 342*b*. A pair of actuation arms 344*a*, 344*b* is mounted at the upstream end of each shaft. A pair of depending arms 346*a*, 346*b*, each support a cylindrical rod 348*a*, 348*b* extending parallel to shafts 340. A pneumatic cylinder 350*a*, 350*b* is connected to arm 344*a*, 344*b* by connector 352*a*, 352*b* on its ram and is fixedly connected on the distal end of shaft 320 by means of bracket 354*a*, 354*b*. Actuating cylinders 350 rotates arms 344 in the direction indicated by arrow 356*a*, 356*b* to cause rods 348 to rotate in the direction indicated by arrows 298 to close the major flaps.

Referring to FIGS. 7 and 8, leading minor flap tucker apparatus 202*b* comprises a generally rectangular base framework including a pair of longitudinal members 360*a*, 360*b* parallel to the container infeed direction 40. Each member has, at its upstream end, an upstanding extension 362*a*, 362*b*. A flat member 364 interconnects the downstream ends of member 360 at a right angle and spaces such members apart. Member 364 is adjustably connected to longitudinal members by bolts 366 received in elongated slots 368 and supports a bracket 370 centered on the upstream side thereof between members 360 for connecting a leading minor flap tucker pneumatic actuation cylinder 372. Members 360 are also interconnected at their upstream end by a second flat member 374 (omitted in FIG. 7). Mounted on the upper or distal ends of upstanding portions 362 are a pair of inwardly curved rods or bridge members 376*a*, 376*b*. Such members are substantially aligned with rods 348 of apparatus 202*a*, when in the major flap closure position, as shown in FIG. 8. Members 376 are spaced laterally apart to provide clearance for a tucker arm 378 to be raised and lowered by cylinder 372.

The tucker arm comprises an elongated member extending generally parallel to members 360, having an L-shaped tucker head 380 at its upstream end, a first transverse shaft 382 is positioned at its lower, downstream end. A second transverse shaft 384 is positioned midway between tucker head and shaft 382. A pair of T-shaped arms 386*a*, 386*b* each have one lateral leg connected to shaft 382 on each side of arm 378. The opposite lateral leg is pivotally connected to adjacent member 360, as indicated by dashed lines, and its depending leg connected to a transverse member 388 mounted on the end of the ram of cylinder 372. Two parallel arms 390*a*, 390*b* are mounted at one end on shaft 384 on each side of arm 378. At the other end, each is connected pivotally into one of a pair of coaxial holes 392 through each of the upstanding portions 362 of members 360 just below bridge members 376. The portion of tucker arm 378 between shaft 384 and tucker head 380 is longitudinally adjustable. On extension of the ram of cylinder 372, the foregoing assembly is operable to extend arm 378 and tucker head 380 through a curved path upstream and upwardly to close the leading minor flap, as indicated by arrow 294 in FIG. 1*a*, by moving in a swinging motion on members 386, 390, as indicated by arrows 392, to the position shown in FIG. 8.

The actuation of cylinders 310 and 350 is coordinated so that the minor flaps are first closed, followed by closure of the major flaps. While sucker assembly 180 is traversing the feed passageway to open container 68*a*, the major flap tuckers 348 are spaced below and upstream of the container, as shown in dashed lines in FIG. 1*a*. Trailing minor flap tucker plate 326 is likewise spaced below and upstream of the container. Upon actuation of trailing minor flap tucker cylinder 310, structure 202*a* swings downstream and upwardly beneath the box to move rods 348 in the direction indicated by arrow 302 and plate 326 in the direction indicated by arrow 326. This action causes the tucker plate to fold the trailing minor flap 191*b* in the direction of arrow 336 and positions rods 348 so that, upon operation of the major flap tucker cylinders 350, rotating the rods in the direction of arrows 298, the major flaps are closed.

First, however, leading minor flap tucker 202*b* swings as indicated by arrow 294 in FIG. 1*a* to close the leading minor flap 191*d*. Then, as cylinders 350 are actuated to swing rods 348 medially, as indicated by arrows 298, cylinder 372 is actuated to retract its ram and return the leading minor flap tucker to its lowered position, relying on the major flaps to hold the leading minor flap in position against the underside of the container. These rods and plate 326 remain in the closed position until pusher 64 feeds the container onto the receiving conveyor.

5. Carton Pushing Apparatus

Referring to FIG. 5, the carton pushing apparatus 64 is horizontally mounted on a base plate 400 in the framework of the machine at the upstream end of the container infeed passageway. A pair of parallel spaced angle members 402*a*, 402*b* extending parallel to the infeed direction 40, are connected normally to base plate 400 at their downstream end and interconnected by a short angle member 404 at their upstream end. A long pneumatic cylinder 406 is centered between and parallel to members 402 and connected to base plate 400 and angle member 404 at each end. Spaced along opposite sides of the cylinder are two stabilizer rods 408*a*, 408*b* slidably received in sleeves 410*a*, 410*b* connected to one side of base plate 400. On the opposite side, the cylinders ram 412 and downstream ends of rods 410 are connected normally to a flat plate 414 upon which are mounted a pair of generally T-shaped pusher plates 416*a*, 416*b*. Each plate is provided with two pair of bolt holes, 418, 420 to enable adjustment of the width of the plates to two different box sizes, for example, a narrow spacing for 8½-inch wide containers and a wider spacing for 14-inch wide containers.

Upon actuation of ram 406, plates 416 are pushed against the upstream end of the container in the infeed passageway to move the carton in the direction of arrow 40. Referring to FIGS. 1*a* and 3, the ram pushes the container in a downstream direction, first lengthwise off tucker plate 326 and rods 348, over the bridge members 376 which retain the major flaps folded on the bottom of the container and finally onto receiving conveyor 66. The ram continues to push until the container is aligned with the dropping mechanism 52. Thereupon, extension of ram 406 ceases and the ram is retracted to make room in the infeed passageway for erection of the next container.

Dropping-to-Receiving Interface Assembly

Figure 12:
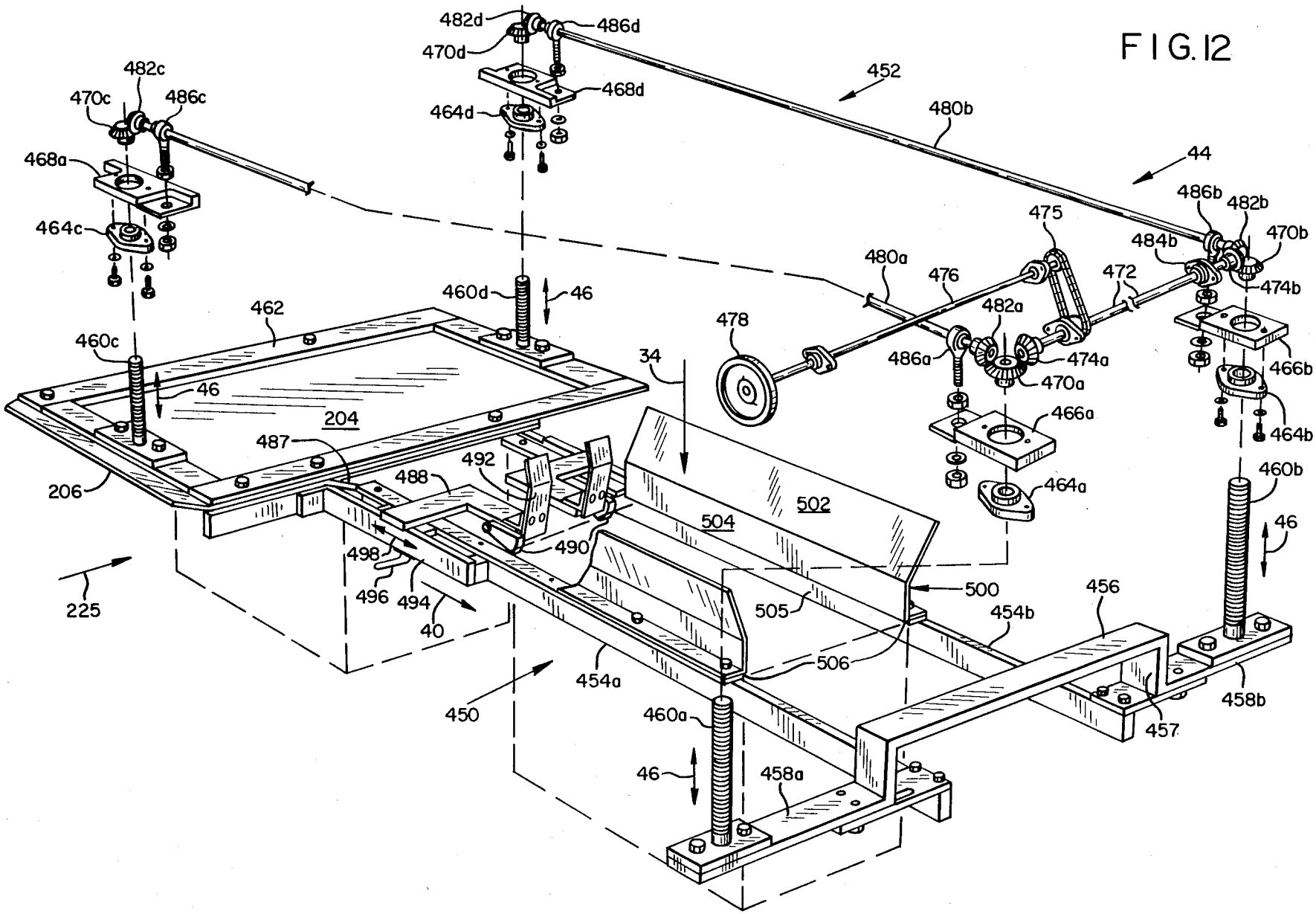
FIG. 12 is a detailed perspective view along arrow 12 in FIG. 1 of the structural interface between the form-dropping mechanism of FIGS. 9 and 10 and the box-receiving conveyor and guide of FIG. 7, the vertical adjustment arrangement in the upper portion of the view being shown in a reduced scale.

Referring to FIG. 12, interface 44 comprises a horizontally-extending framework 450 and a vertical adjustment mechanism 452. The framework generally comprises a pair of elongated flat members 454*a*, 454*b* spaced apart on opposite sides of the container infeeding passageway. The members are interconnected at their upstream end by guide plate 204 and at the downstream end by a transverse bridging member 456. The central portion of bridging member is vertically offset above members 454 by portions 457 and the lateral end 458*a*, 458*b*, each support a vertically-extending suspension screw 460*a*, 460*b*, respectively. Plate member 204 is provided with a supporting rectangular frame 462, upon which are mounted a pair of screws 460*c*, 460*d* like 460*a*, 460*b*, extending vertically and spaced laterally apart along a transverse mid-line through plate 204. Screws 460*a* and 460*d* are threaded oppositely of the other suspension screws, i.e., left-hand threaded.

Received on each screw is a bearing 464 which is bolted through a bracket 466*a*, 466*b* at the downstream end and brackets 468*a*, 468*b* at the upstream end to an upper portion of framework of machine 20 supporting the forms infeed conveyor and dropping mechanism. A cone gear 470*a*–470*d* is supported by each bearing and threadedly received on each screw 460 to support guide assembly 450.

In adjustment mechanism 452, a transverse rotating shift 472 has cone gears 474 at each end meshing with gears 470*a*, 470*b* at right angles. A second transverse shaft 476, a offset from shaft 472, and drivingly connected to it by a sprocket-chain drive 475, extends laterally to a manually-rotatable wheel 478 which is rotated to thread gears 470*a*, 470*b* vertically on screws 458*a*, 458*b*. Two longitudinal shafts 480*a*, 480*b* each cone gears 482*a*, 482*b* at one end meshing normally with gears 470*a*, 470*b* and extend upstream to cone gears 484*a*, 484*b* to mesh with gears 470*c*, 470*d* for threading those gears vertically on screws 460*c*, 460*d*. Bearings 484 mounted near each end of shaft 472 support that shaft in the framework of apparatus 20. Shafts 480 are journaled for rotation in bearing bolts 486*a*–486*d* threading into brackets 466, 468 to connect the shafts 480 at their downstream and upstream ends, respectively, to such brackets.

As mentioned above, plate 204 initially guides a container along its upper edges into the infeed passageway between members 454. As the container is pushed onto the receiving conveyor, its leading corners are aligned with members 454 by convergently inclined surfaces 487. The container then passes beneath two L-shaped members 488, one atop each member 454, extending medially of the passageway and supporting, at their downstream ends, a pair of gravity stops 490 and a pair of form guides 492. Members 488 are connected to each frame member 454 by a slideway 494, secured therein by a bolt releasable by handle 496 to allow longitudinal adjustment, as indicated by arrow 498.

Lateral form guides 500, comprising two rectangular plates, each having an inwardly inclined upper portion 502 and a vertical lower portion 504, are mounted on members 454. Flat elongated strips 506 are sandwiched between members 454 and guides 500 and extend upstream of the latter to plate 204. Guides 500 and strips 506 are positioned to overhang members 454 inwardly to define guideways 505 for the upper edges of the containers.

Container-Receiving and Discharging Conveyor Subsystem

Referring to FIGS. 3, 13 and 14, the container-receiving and discharge conveyor subsystem 66 includes a horizontal live roller conveyor section 520, an inclined belt conveyor section 522 connected in line end-to-end to section 520 for articulation about a joint 524 pivotable about a horizontal axis. An elevator mechanism 526, actuated by a pneumatic cylinder 528 through a rotatable linking arm 530 is connected beneath conveyor 520 for raising conveyor 520, as shown in FIG. 14, to the receiving position and lowering it, as indicated by arrow 532 in FIG. 13, for discharge of a form-filled container 38, as indicated by arrow 42.

Roller conveyor 520 comprises a pair of parallel side rails 534*a*, 534*b*. A plurality of rollers 536 extend between the side rails and are journaled for rotation therein. Drive shafts 538 on each of rollers 536 extend through side rail 534*a* to a series of drive sprockets 540 and the rollers are interconnected in pairs by a plurality of roller chains (not shown).

Conveyor 522 comprises an idler roller 542 coaxially mounted at joint 524. Roller 542 has a shaft journaled inside rail 534*a*, carrying a sprocket 544 for driving the downstream end roller 536*a* and thereby the remaining rollers via a chain connected to the aforementioned sprockets 540. Housing 541 encloses the sprockets.

Conveyor belt 522 has a drive roller 546 mounted in a support stand 548 in a position parallel to roller 542 and spaced therefrom by a pair of side rails 550*a*, 550*b*. A conveyor drive motor 552 is drivingly connected to roller 546 through a gear box 554 mounted on an outboard end of floor stand 548, adjacent side rail 550*b*. Side rails 550 are journaled to pivot on the upper ends of uprights 556*a*, 556*b* of stand 548 to facilitate raising and lowering the upstream end of the belt conveyor.

Referring to FIG. 13, support stand 548 is connected at each end by frame members 560 extending parallel to the side rails of the conveyors. Elevator mechanism 528 is mounted by means of two bearings 562 spaced along each frame member 560. A pair of shafts 564*a*, 564*b* extend normal to frame members 560 from side to side beneath conveyors 520, 522 through bearings 562. A pair of L-shaped flat linkage arm members 566 are mounted on each shaft and spaced apart in approximate alignment with the side rails of the conveyors. Linkage arms 566*a*, 566*b* on each side of the conveyor are connected at their short depending distal ends by a straight linking member 568 extending along the inner side of frame member 560 and lying parallel thereto. The longer leg of each of members 566 extends laterally of shaft 564 in the upstream direction nearly parallel to side rails 550 of conveyor 522 and is connected at its distal end to a tab 570*a*, 570*b* depending from each of side rails 534 through a short, straight, vertically-oriented linkage member 572*a*, 572*b*. Pivot arm 530 of actuator 528 is mounted on shaft 546*b*. A pair of springs 574 are mounted on rods 576 to spring dampen action of the elevator. The rods are arranged parallel between linking members 568 and have an end 576 connected thereto just downstream of shaft 564*b*. The downstream ends of shaft 576 extend slidably through tabs 580 depending from a flat member 582 extending transversely below the conveyors and connected to the support stand 548 by means not shown.

Upon actuation of cylinder 528 to extend its ram in the direction indicated by arrow 584, through arm 530, shafts 564 and linkage arms 566 are rotated in the direction of arrow 586 to lift conveyor 520 as indicated by arrow 588 to the receiving position while maintaining such conveyor level.

A pair of container side guides 590 are spaced apart at opposite sides of conveyor 520. Each guide comprises a flat member with an outwardly-inclined upstream end 592 for centering a container infed in the direction of arrow 40. Each guide is connected at two points to its respective side plate 534 by means of two upstanding posts 594*a*, 594*b* through a bolt 596 laterally adjustable to adjust the spacing between guides 590. A second pair of guides 598 is similarly mounted on side rails 550 of the belt conveyor for maintaining a form-filled carton in alignment with the direction of outfeed, indicated by arrow 42.

Referring to FIG. 13, a cat whisker 600 of sensor 602 extends into the passageway between guide rails 590 at the downstream end of rail 590*b*. Sensor 602 is mounted on the side of rail 590*b* remote from the passageway and is adjustably positionable longitudinally along such rail to alter the position at which it is actuated. This cat whisker is positioned to sense the downstream end of a container as such end comes into alignment with the downstream end stop 160 (FIG. 10) of the dropping mechanism. A second such sensor 601 is positioned along belt conveyor 522 for detecting discharge of a container.

A pair of stops 604, mounted on arms 605, is positioned to raise and lower between the conveyor rollers 536*b* and 536*c*, when conveyor 520 is raised, to stop a box in precise alignment with member 166, as shown in FIG. 10. By precise alignment is meant that the inner surface at the downstream end of the container is not upstream but is parallel with or very slightly downstream of the upstream facing surface of member 160. Stops 604 are passively raised and lowered upon raising and lowering of conveyor 520 by means of elevator mechanism 526. Thus, the stops are raised when the conveyor is in the receiving position, and lowered when the conveyor is lowered for discharging a form-filled container. When a container is infed to receiving conveyor 520, substantially simultaneously as its downstream end contacts stops 604, it is detected by sensor 602 and, through controls described hereinafter, causes a pusher 64 of FIG. 5 to cease pushing the box in the direction of arrow 40.

Control System

Referring to FIG. 15, the various sensors, actuators and motors used in apparatus 20 are illustrated in their respective positions within the apparatus framework.

Additional sensors, shown only in FIGS. 16 and identified as "LS" for limit switch and "CS" for "contact switch" are provided by magnetic switches in pneumatic actuators 145, 184, 372, and 528. FIG. 16*a*, upper right, shows electrical circuitry for such sensors.

The pneumatic actuators are controlled by a pneumatic control block 620 comprising a vertically-oriented stack of solenoid-operated pneumatic valves to which pressurized air is provided through a conventional pneumatic valve manifold (not shown). By operation of the valves, the pressurized air is shunted through tubing (not shown) to the various actuators. One actuator not above-described is a Venturi vacuum device 622 connected to valve 3 in block 620 and operable upon the input of air under pressure via line 624 to provide a vacuum on output lines 626 to vacuum assembly 180.

Operation of the motors and actuators of FIG. 15 is controlled by an electrical control circuit 700, shown in FIGS. 16*a*, 16*b* and 16*c*. The organization of the control circuit and the elements controlled thereby appears in detail in the notations in the Figures and in the following description of operation sequence, and so is only described generally.

Referring first to FIG. 16*a*, lines 1–13, show the three phase power circuitry for drive motors 71, 99, 552 (FIG. 15) and a step down transformer interface for powering the control circuitry of FIGS. 16*b* and 16*c*.

Starting in FIG. 16*b*, control lines 16–20 contain various switches for starting up machine 20, starting and stopping the stack infeed conveyor motor (1M) and indicators showing that the power is on and that the infeed conveyor is operating. Lines 21–22 and lines 45–50 control operation of the dropping mechanism, including sensing that a stack is in the dropping mechanism and that a box is in position on the receiving conveyor (referred to in the circuit notations as the elevator). Such circuitry also controls operation of the centering walls and finger or drop rollers to open gate 56 after closure of the dropping mechanism to admit the next stack of forms, closing the gate, and opening the dropping mechanism once a container is positioned on the receiving conveyor.

Lines 24–32 control operation of the container-erecting mechanism and line 39, controlled through line 40, maintains a vacuum on an erected container "on deck" until the receiving conveyor is clear and the box pusher starts to infeed the next container. Control lines 33–34, 42, 43 and 60 control operation of the bottom closing mechanism, including holding the major flap tuckers up until the box pusher has infed a box on deck into the receiving conveyor, whereupon the major flap tuckers are lowered and the bottom closing apparatus is retracted out of the way of the next carton to be erected by the erecting mechanism.

The elevator and discharge conveyor are controlled by lines 47, 51–57 and 59 serially to lower the receiving conveyor and to start the discharge conveyor drive after a stack of forms has been dropped into the container. Upon sensing that the container has cleared the discharge conveyor, such circuitry raises the elevator back to its receiving position.

Set-up and Operation Sequence

Apparatus 20 is preferably used in conjunction with a downstream conveyor system (not shown) including apparatus for performing the steps of compressing the stack of forms, applying a lid and securing the lid to the container. Accordingly, each container coming off the discharge conveyor is conveyed to a forms compressor comprising a pneumatic cylinder having a rectangular flat member positioned on the end of its ram for pressing the forms down into the box. Then, the container passes over a conventional container bottom-taping machine. From there, the container is conveyed to a strapping machine to strap on a lid, applied anywhere along the conveyor following the compressor. Alternatively, a conventionally-available lid-forming and applying machine can be inserted in the conveyor line upstream of the strapping machine. From the strapping machine, the cartons are preferably conveyed to a pallet-forming machine to be stacked on a pallet. Although apparatus 20 is shown as being provided with forms from only a single form-making machine and the immediately-preceding description indicates only one such machine boxing forms for input to the downstream conveyor system, it should be understood that stacks of forms can be supplied to apparatus 20 from more than one form-making machine and that the output of several of machines 20 can be input into the above-described downstream conveyor system.

Following is a sequence of operation of apparatus 20, in which the terminology is the same as that used in FIGS. 16*b* and 16*c*.

1. Check Emergency STOP button (should be in OUT position).
2. Turn power switch to ON position.
3. Position SELECTOR switch for appropriate CASE SIZE and adjust CASE FEED magazine to proper position for CASE SIZE.
4. Fill magazine with CASES.
5. Start FORMS conveyor.
6. Start VACUUM PUMP (this starts sequence of erection and placement of case).
7. When VACUUM PUMP starts:
   A. VACUUM PICK UP extends to FETCH CASE.
   B. VACUUM VALVE opens.
8. When VACUUM PICK UP is fully extended and in contact with the CASE, TR3 TIMER is energized.
9. When TR3 TIMER times out:
   A. VACUUM PICK UP fetches CASE to FLAP FOLDING POSITION.
   B. CASE contacts LIMIT SWITCH which:
      a. Confirms its arrival to FLAP FOLDING POSITION.
      b. Closes CASE ESCAPEMENT.
      c. Energizes TR4 TIMER.
10. TR4 TIMER energizes leading and trailing MINOR FLAP TUCKERS simultaneously, causing them to go to UP position.
11. When MINOR FLAP TUCKERS reach fully UP position, MAJOR FLAP TUCKERS go to UP position.
12. When MAJOR FLAP TUCKERS reach fully UP position:
    A. Leading MINOR FLAP TUCKER goes DOWN.
    B. VACUUM VALVE CLOSES.
13. At this time IF:

A. Leading MINOR FLAP TUCKER is DOWN.
B. ELEVATOR is UP.
C. NO CASE is in ELEVATOR.
PUSHER will push ERECTED CASE into position to accept LOAD of FORMS.

14. When PUSHER extends to REED (Stroke Limiter) SWITCH position selected by CASE SIZE SELECTOR SWITCH:
A. Trailing MINOR FLAP TUCKER DROPS.
B. MAJOR FLAP TUCKERS DROP.
C. PUSHER RETRACKS.

15. When the completion of this sequence is verified, the process STARTS OVER again.

16. Machine is now prepared to ACCEPT FORMS for LOADING.
A. GATE is open.
B. DROP ROLLERS are CLOSED and RUNNING.
C. CONVEYOR is RUNNING.

17. PLACE FORMS on conveyor in proper alignment with DROP ZONE GATE.

18. When FORMS enter DROP ZONE, a gap is drawn between STACKS to prevent two STACKS from entering the DROP ZONE at one time.

19. When FORMS trip LIMIT SWITCH in DROP ZONE, Center Rolls CLOSE and TR4 TIMER is energized (TIMER is adjustable from 36 to 360 seconds. If FORMS are not dropped into case before TIMER times OUT, Drop Roller Drive Motor STOPS and RED light on operating panel comes ON).

20. IF:
A. CENTERING ROLLS are CLOSED.
B. CASE is in position to ACCEPT DROP of FORMS.
DROP ROLLERS OPEN, dropping forms into case and TR5 TIMER is energized.

21. When TR5 TIMER times OUT:
A. DROP ROLLERS CLOSE.
B. ELEVATOR LOWERS.
C. TR6 TIMER is energized.

22. When TR6 TIMER times OUT:
A. CENTERING WALLS OPEN.
B. Next FORMS STACK enters DROP ZONE.

23. When ELEVATOR reaches BOTTOM, Discharge Conveyor Motor STARTS, moving loaded case OUT of machine.

24. When loaded case TRIPS Discharge Switch, TR7 TIMER is energized.

25. When TR7 times OUT:
A. Discharge Conveyor Drive motor STOPS.
B. Elevator RAISES to position to accept next erected case and the process can START OVER again.

Having illustrated and described the principles of our invention and a preferred embodiment thereof, it should be readily apparent to those skilled in the art that the invention may be modifed in arrangement and detail without departing from such principles. We claim all such modifications coming within the scope and spirit of the following claims.

I claim:

1. Apparatus for boxing forms, comprising:
dropping means for dropping a stack of forms vertically into a container receivingly positioned beneath the dropping means;
first infeeding conveyor means for infeeding a stack of forms one at a time in a predetermined direction horizontally into the dropping means; and
second infeeding means positioned beneath the first infeeding means for infeeding a container to the container-receiving position;
the dropping means including a pair of side-by-side conveyor means fixed at the same elevation as the first infeeding conveyor means;
means for driving the pair of side-by-side conveyor means so as to accelerate the stack from the first infeeding conveyor means into the dropping means; and means for moving said side-by-side conveyor means horizontally apart to drop the stack of forms into the container.

2. Apparatus according to claim 1 including means aligned with the second infeeding means for discharging the container, after filling with forms, in the same predetermined direction.

3. Apparatus according to claim 2 in which the discharging mans includes elevator means for lowering the filled container relative to the dropping means so as to provide vertical clearance between the stack of forms and the dropping means for discharge of a first container and raising to receive a second container from the second infeeding means.

4. Apparatus according to claim 2 including sensor means positioned at a discharge end of the container-receiving position for sensing the presence of a box in said position and the discharge of a box therefrom to control actuation of the second infeeding means.

5. Apparatus according to claim 3 including means responsive to said sensor means to control the second infeeding means so as to stop infeeding the container in said predetermined direction when a first end of the container is aligned beneath an end of the dropping means so as to center the container along said direction beneath the dropping means.

6. Apparatus according to claim 4 including second control means responsive to said sensor means upon sensing passage of a second end of a first said container during discharge from the receiving position for actuating the infeeding of a second container.

7. Apparatus according to claim 1 including:
first means for sensing the presence of a stack in the dropping means;
second sensing means for sensing the presence of a container in the receiving position; and
means jointly responsive to said first and second sensing means for actuating the dropping means only when containing a stack of forms and a container is in the receiving position.

8. Apparatus according to claim 7 including:
means positioned at an infeed end of the receiving position, beneath the first infeed means, for erecting a container;
third sensing means for sensing the presence of an erected container at said infeed end of the receiving position; and
means jointly responsive to the second and third sensing means for actuating the second infeeding means upon sensing the absence of a container in the receiving position and the presence of an erected container at said infeed end.

9. Apparatus according to claim 8 including control means responsive to the third sensing means sensing absence of an erected container for actuating the container erecting means.

10. Apparatus according to claim 1 in which the second infeeding means is aligned with the first infeeding conveyor means for infeeding said container in the same predetermined direction as the stack.

11. Apparatus according to claim 1 for use in combination with a half-slotted container, in which the second infeeding means includes container side guide means for guiding the container into alignment with opposite layer sides of the dropping means and the dropping means includes form guide means extending between each of said opposite sides of the dropping means and underlying upper edges of the container aligned therewith by the container guide means for guiding a stack of forms downward into the container.

12. Apparatus according to claim 11 in which the container is sized side-to-side to close tolerances around the stack of forms so as relievably to trap air in the container and thereby provide a cushioning effect upon dropping a stack of forms in the container.

13. Apparatus according to claim 11 including means defining a guideway extending lengthwise of the form guide means for engaging opposite lateral sides of the container along an upper edge thereof.

14. Apparatus according to claim 13 in which the form guide means and guideways are vertically-adjustable as a unit to vary the height of the containers, the receiving position being defined by a container supporting and discharging conveyor positioned at a predetermined elevation below the dropping means.

15. Apparatus according to claim 14 including elevator means for lowering the supporting and discharging conveyor to a second elevation to provide head room for the stack of forms to pass freely beneath the form guide means upon discharging a filled container.

16. Apparatus according to claim 14 including erecting means for erecting a container at an infeed end of the receiving position and top guide means for guiding the container into said guideway;

the top guide means, form guide means and guideway defining means being interconnected and including means for vertical adjustment thereof as a unit.

17. Apparatus according to claim 16 including means for closing a pair of bottom flaps of the container and resiliently retaining the container in engagement with the top guide means.

18. Apparatus according to claim 1, further including:

means for infeeding knockdown containers one at a time from a stack thereof in a direction normal to the plane of the knockdown containers into a defined space;

means for opening an end one of said knockdown containers into said defined space to form a rectangular container open at two opposite ends including one end having first and second closure flaps foldable in two dimensions; and first and second closure means movable as a unit from a first position adjacent but spaced from said one end outside said defined space in a first direction to a second position within said space overlapping the second closure flap for the first closure means to close the first closure flap;

the second closure means being movable in a second direction normal to the first direction to close the second flap.

19. Apparatus for boxing forms, comprising:

dropping means for dropping a stack of forms into a container receivingly positioned beneath the dropping means;

accumulating conveyor means for infeeding stacks of forms to the dropping means and retaining a stack of forms thereon during operation of the dropping means;

accelerating conveyor means in line with the accumulator conveyor means for infeeding a stack of forms from the accumulating conveyor means to the dropping means; and gate means between the accumulating conveyor means and the accelerating conveyor means for opening and closing a passageway to the dropping means;

the accelerating conveyor means including a pair of side-by-side conveyors separable by horizontal movement to drop the stack of forms and driven at a speed greater than the speed of the accumulating conveyor means so as to space a first stack of forms apart from a second stack a distance such that the gate means can close between the stacks to detain the second stack of forms on the accumulating conveyor during operation of the dropping means to drop the first stack into the container.

20. Apparatus according to claim 19 including means for actuating the dropping means and means cooperable with said actuating means for opening the gate means to admit the first stack of forms to the dropping means and then to close the gate to exclude the second stack of forms until the first stack is dropped.

21. Apparatus according to claim 19 in which each of the pair of side-by-side conveyors comprises a live roller conveyor positioned to form a floor of the dropping means in horizontal alignment with the accumulating conveyor means.

* * * * *